US010300730B2

(12) United States Patent
Godfrey et al.

(10) Patent No.: US 10,300,730 B2
(45) Date of Patent: May 28, 2019

(54) METHODS OF MANUFACTURING IMAGE ELEMENT ARRAYS FOR SECURITY DEVICES

(71) Applicant: DE LA RUE INTERNATIONAL LIMITED, Basingstoke, Hampshire (GB)

(72) Inventors: John Godfrey, London (GB); Adam Lister, Andover (GB)

(73) Assignee: DE LA RUE INTERNATIONAL LIMITED, Basingstoke (GB)

( * ) Notice: Subject to any disclaimer, the term of this patent is extended or adjusted under 35 U.S.C. 154(b) by 0 days.

(21) Appl. No.: 15/770,031

(22) PCT Filed: Nov. 7, 2016

(86) PCT No.: PCT/GB2016/053468
§ 371 (c)(1),
(2) Date: Apr. 20, 2018

(87) PCT Pub. No.: WO2017/081447
PCT Pub. Date: May 18, 2017

(65) Prior Publication Data

US 2018/0304669 A1 Oct. 25, 2018

(30) Foreign Application Priority Data

Nov. 13, 2015 (GB) ..... 1520085.0

(51) Int. Cl.
*B42D 25/324* (2014.01)
*B42D 25/309* (2014.01)
(Continued)

(52) U.S. Cl.
CPC ..... *B42D 25/324* (2014.10); *B41M 1/04* (2013.01); *B41M 1/08* (2013.01); *B41M 3/14* (2013.01);
(Continued)

(58) Field of Classification Search
CPC ..... B42D 25/324; B42D 25/23; B42D 25/24; B42D 25/309; B42D 25/378; B42D 25/48;
(Continued)

(56) References Cited

U.S. PATENT DOCUMENTS 4,509,424 A 4/1985 Germann
4,652,015 A 3/1987 Crane
(Continued)

FOREIGN PATENT DOCUMENTS

EP 0 059 056 A1 9/1982
EP 0 860 298 A2 8/1998
(Continued)

OTHER PUBLICATIONS

Feb. 1, 2017 International Search Report and Written Opinion issued in International Patent Application No. PCT/GB2016/053468.
(Continued)

*Primary Examiner* — Justin V Lewis
(74) *Attorney, Agent, or Firm* — Oliff PLC

(57) ABSTRACT

A method of manufacturing an image element array includes: providing a production tool having a surface pattern of ink-receptive elements spaced by areas which are not, the ink-receptive elements defining the array image elements; applying a multi-colored first image formed of a inks to only the ink-receptive elements; and transferring only the portions of the multi-colored first image corresponding to the image elements from the production tool to a substrate. An image element array is formed on the substrate. The production tool surface pattern is configured such that when viewing and image element arrays overlap, each viewing element within an image element array first region directs light from a respective image element or from
(Continued)

a respective gap. The viewing angle in the first region directs light from either the array or the gaps.

19 Claims, 24 Drawing Sheets

(51) Int. Cl.

| | |
|---|---|
| ***B42D 25/24*** | (2014.01) |
| ***B42D 25/23*** | (2014.01) |
| ***B41M 1/08*** | (2006.01) |
| ***B41M 3/14*** | (2006.01) |
| ***B42D 25/425*** | (2014.01) |
| ***B42D 25/29*** | (2014.01) |
| ***B42D 25/45*** | (2014.01) |
| ***B42D 25/455*** | (2014.01) |
| ***B42D 25/351*** | (2014.01) |
| ***B42D 25/46*** | (2014.01) |
| ***B42D 25/342*** | (2014.01) |
| ***B42D 25/355*** | (2014.01) |
| ***B42D 25/48*** | (2014.01) |
| ***B42D 25/378*** | (2014.01) |
| ***B41M 1/04*** | (2006.01) |
| *B41M 1/06* | (2006.01) |

(52) U.S. Cl.
CPC ..... *B41M 3/148* (2013.01); *B42D 25/23* (2014.10); *B42D 25/24* (2014.10); *B42D 25/29* (2014.10); *B42D 25/309* (2014.10); *B42D 25/342* (2014.10); *B42D 25/351* (2014.10); *B42D 25/355* (2014.10); *B42D 25/378* (2014.10); *B42D 25/425* (2014.10); *B42D 25/45* (2014.10); *B42D 25/455* (2014.10); *B42D 25/46* (2014.10); *B42D 25/48* (2014.10); *B41M 1/06* (2013.01)

(58) Field of Classification Search
CPC .... B42D 25/46; B42D 25/351; B42D 25/355; B42D 25/455; B42D 25/45; B42D 25/29; B42D 25/425; B42D 25/342; B41M 1/08; B41M 3/148; B41M 1/04; B41M 3/14; B41M 1/06
USPC ..... 283/67, 70, 72, 94, 98
See application file for complete search history.

(56) References Cited

U.S. PATENT DOCUMENTS

| | | | | |
|---|---|---|---|---|
| 4,766,809 | A | 8/1988 | Giori et al. | |
| 4,892,336 | A | 1/1990 | Kaule et al. | |
| 6,856,462 | B1 | 2/2005 | Scarbrough et al. | |
| 2012/0189159 | A1 | 7/2012 | Vincent | |
| 2012/0268819 | A1 | 10/2012 | Commander et al. | |
| 2013/0044362 | A1 | 2/2013 | Commander et al. | |
| 2013/0098255 | A1 | 4/2013 | Kamoda | |
| 2014/0103632 | A1 | 4/2014 | Camus et al. | |
| 2014/0376096 | A1* | 12/2014 | Jolic | B41M 3/14 283/85 |
| 2015/0059603 | A1 | 3/2015 | Kamoda | |
| 2016/0167421 | A1 | 6/2016 | Holmes | |
| 2016/0176221 | A1 | 6/2016 | Holmes | |
| 2017/0008271 | A1* | 1/2017 | Schaede | B41F 31/00 |

FOREIGN PATENT DOCUMENTS

| | | | | |
|---|---|---|---|---|
| EP | 0 982 125 | A2 | 3/2000 | |
| EP | 1 398 174 | A1 | 3/2004 | |
| EP | 2 631 085 | A1 | 8/2013 | |
| EP | 2 902 210 | A1 | 8/2015 | |
| GB | 1 288 360 | A | 9/1972 | |
| GB | 2 094 715 | A | 9/1982 | |
| GB | 2 094 717 | A | 9/1982 | |
| GB | 2490780 | A | 11/2012 | |
| WO | 83/000659 | A1 | 3/1983 | |
| WO | 95/10419 | A1 | 4/1995 | |
| WO | 95/10420 | A1 | 4/1995 | |
| WO | 00/39391 | A1 | 7/2000 | |
| WO | 03/054297 | A2 | 7/2003 | |
| WO | 03/091952 | A2 | 11/2003 | |
| WO | 03/091953 | A2 | 11/2003 | |
| WO | 03/095188 | A2 | 11/2003 | |
| WO | 2005/052650 | A2 | 6/2005 | |
| WO | 2010/099571 | A1 | 9/2010 | |
| WO | 2011/051668 | A1 | 5/2011 | |
| WO | 2011/051669 | A1 | 5/2011 | |
| WO | 2011/051670 | A2 | 5/2011 | |
| WO | 2011/107788 | A1 | 9/2011 | |
| WO | 2012/027779 | A1 | 3/2012 | |
| WO | 2015/032515 | A1 | 3/2015 | |
| WO | 2015/044671 | A1 | 4/2015 | |
| WO | WO-2015118447 | A2 * | 8/2015 | B41F 31/00 |

OTHER PUBLICATIONS

May 9, 2017 Combined Search and Examination Report issued in British Patent Application No. 1618731.2.
May 16, 2016 Combined Search and Examination Report issued in British Patent Application No. 1520085.0.

* cited by examiner

METHODS OF MANUFACTURING IMAGE ELEMENT ARRAYS FOR SECURITY DEVICES

This invention relates to methods of manufacturing image element arrays for use in security devices, as well as security devices themselves. Security devices are used for example on documents of value such as banknotes, cheques, passports, identity cards, certificates of authenticity, fiscal stamps and other secure documents, in order to confirm their authenticity.

Articles of value, and particularly documents of value such as banknotes, cheques, passports, identification documents, certificates and licences, are frequently the target of counterfeiters and persons wishing to make fraudulent copies thereof and/or changes to any data contained therein. Typically such objects are provided with a number of visible security devices for checking the authenticity of the object. Examples include features based on one or more patterns such as microtext, fine line patterns, latent images, venetian blind devices, lenticular devices, moiré interference devices and moiré magnification devices, each of which generates a secure visual effect. Other known security devices include holograms, watermarks, embossings, perforations and the use of colour-shifting or luminescent/fluorescent inks. Common to all such devices is that the visual effect exhibited by the device is extremely difficult, or impossible, to copy using available reproduction techniques such as photocopying. Security devices exhibiting non-visible effects such as magnetic materials may also be employed.

One class of security devices are those which produce an optically variable effect, meaning that the appearance of the device is different at different angles of view. Such devices are particularly effective since direct copies (e.g. photocopies) will not produce the optically variable effect and hence can be readily distinguished from genuine devices. Optically variable effects can be generated based on various different mechanisms, including holograms and other diffractive devices, and also devices which make use of viewing elements such as focusing elements (e.g. lenses or mirrors) and masking grids, including moiré magnifier devices, integral imaging devices, so-called lenticular devices and "venetian blind" type effects.

Lenticular devices typically comprise an array of focusing elements, such as cylindrical lenses, overlying a corresponding array of image elements, or "slices", each of which depicts only a portion of an image which is to be displayed. Image slices from two or more different images (one or more of which could be blank, or a uniform block colour) are interleaved and, when viewed through the focusing elements, at each viewing angle, only selected image slices will be directed towards the viewer. In this way, different composite images can be viewed at different angles. However it should be appreciated that no magnification typically takes place and the resulting image which is observed will be of substantially the same size as that to which the underlying image slices are formed. Some examples of lenticular devices are described in U.S. Pat. No. 4,892,336, WO-A-2011/051669, WO-A-2011051670, WO-A-2012/027779 and U.S. Pat. No. 6,856,462. More recently, two-dimensional lenticular devices have also been developed and examples of these are disclosed in British patent application numbers 1313362.4 and 1313363.2. Lenticular devices have the advantage that different images can be displayed at different viewing angles, giving rise to the possibility of animation and other striking visual effects which are not possible using the moiré magnifier or integral imaging techniques.

The same type of image element array can be combined with alternative types of viewing elements (in place of a focussing element array) to achieve similar visual effects. Examples of such devices are disclosed in US20120189159. For instance, a masking grid comprising a periodic array of apertures in an otherwise opaque layer, spaced from the image element array, will selectively display different ones of the underlying image elements to the viewer depending on the viewing angle due to the parallax effect. Examples of such devices include so-called "venetian blind" devices.

Security devices such as these depend for their success significantly on the resolution with which the image element array can be formed. Since the security device must be thin in order to be incorporated into a document such as a banknote, any focusing elements required to form a lenticular device must also be thin, which by their nature also limits their lateral dimensions. For example, lenses used in such security elements preferably have a width or diameter of 50 microns or less, e.g. 30 microns. In a lenticular device this leads to the requirement that each image element must have a width which is at most half the lens width. For example, in a "two channel" lenticular switch device which displays only two images (one across a first range of viewing angles and the other across the remaining viewing angles), where the lenses are of 30 micron width, each image element must have a width of 15 microns or less. More complicated lenticular effects such as animation, motion or 3D effects usually require more than two interlaced images and hence each element needs to be even finer in order to fit all of the image elements into the optical footprint of each lens. For instance, in a "six channel" device with six interlaced images, where the lenses are of 30 micron width, each image element must have a width of 5 microns or less.

The same is true for many security devices which use alternative types of viewing elements in place of focusing elements, such as devices which rely on the parallax effect, e.g. venetian blind devices. In order to perceive a change in visual appearance upon tilting over acceptable angles, the aspect ratio of the spacing between the plane on which the image element array is located and that on which the viewing element array is carried (which is limited by the thickness of the device) to the spacing between image elements must be high. This in practice requires the image elements to be formed at high resolution to avoid the need for an overly thick device.

Typical processes used to manufacture image elements for security devices are based on printing and include intaglio, gravure, wet lithographic printing as well as dry lithographic printing. The achievable resolution is limited by several factors, including the viscosity, wettability and chemistry of the ink, as well as the surface energy, unevenness and wicking ability of the substrate, all of which lead to ink spreading. With careful design and implementation, such techniques can be used to print pattern elements with a line width of between 25 μm and 50 μm. For example, with gravure or wet lithographic printing it is possible to achieve line widths down to about 15 μm.

Methods such as these are limited to the formation of single-colour image elements, since it is not possible to achieve the high registration required in terms of translational (x,y) position and skew between different workings of a multi-coloured print. In the case of a lenticular device for example, the various interlaced image elements must all be defined on a single print master (e.g. a gravure or lithographic cylinder) and transferred to the substrate in a single working, hence in a single colour. The various images displayed by the resulting security device will therefore be monotone, or at most duotone if the so-formed image elements are placed against a background of a different colour.

One approach which has been put forward as an alternative to the printing techniques mentioned above is used in the so-called Unison Motion™ product by Nanoventions Holdings LLC, as mentioned for example in WO-A-2005052650. This involves creating pattern elements ("icon elements") as recesses in a substrate surface before spreading ink over the surface and then scraping off excess ink with a doctor blade. The resulting inked recesses can be produced with line widths of the order of 2 μm to 3 μm. This high resolution produces a very good visual effect, but the process is complex and expensive. Further, limits are placed on the minimum substrate thickness by the requirement to carry recesses in its surface. Again, this technique is only suitable for producing image elements of a single colour.

The present invention provides a method of manufacturing an image element array for an optically variable security device, comprising:

providing a production tool having a surface pattern of ink-receptive elements spaced by areas which are not ink-receptive, the ink-receptive elements defining the image elements of the desired image element array;

applying a multi-coloured first image formed of a plurality of inks to only the ink-receptive elements of the surface pattern and not to the areas in between;

transferring the portions of the multi-coloured first image corresponding to the image elements of the desired image element array from the production tool to a substrate, by bringing the plurality of inks on the surface pattern into contact with the substrate or with a transfer assembly which then contacts the substrate, whereby an image element array is formed on the substrate;

wherein the surface pattern on the production tool is configured such that, when a viewing element array is overlapped with the image element array, each viewing element within a first region of the image element array directs light from a respective one of the image elements or from a respective one of the gaps between the image elements in dependence on the viewing angle, whereby depending on the viewing angle the viewing element array in the first region directs light from either the array of image elements or from the gaps therebetween, such that upon changing the viewing angle, the first image is displayed by the image elements in combination across the first region of the image element array at a first range of viewing angles and not at a second range of viewing angles.

It will be appreciated that the so-produced image element array is configured to form part of a security device which uses a viewing component array to selectively display different images, or different regions of one image, such as a lenticular device or a parallax-based device (examples of which were described above) depending on the viewing angle. This is achieved through appropriate design of the pattern of ink-receptive and non-ink-receptive areas on the surface of the production tool. That is, the shape, size and relative positions of the ink-receptive areas are arranged to define the locations in which elements of the first image are ultimately to be provided, interlaced with gaps (or a second image, as described below). As makers of lenticular devices and similar security devices will appreciate, typically this will involve designing the image elements to be periodic in at least one direction, at least in the first region of the array, the periodicity corresponding to that of the viewing element array with which the image element array is to be combined. Thus, at least in the first region, the viewing element array referred to above will preferably be periodic in at least one dimension and, still preferably, the periodicity of the viewing element array will be substantially equal to or a multiple of that of the image elements in the first region. The image elements in the first region may also each be of the same dimension as one another in the direction(s) of periodicity, and in preferred examples the elements in the first region may be identical to one another in size and shape (although could be curtailed to different extents by the periphery of the first region).

By defining the image elements using a surface pattern on a production tool, the present method removes any need for highly accurate (e.g. on the micron level) registration between the different inks, referred to herein as "micro-registration". The multi-coloured first image can be formed using standard printing techniques capable of relatively coarse registration (e.g. to 100 microns) between the plurality of inks, which is acceptable to the naked eye, referred to herein as "macro-registration". The size and position of each image element is determined by the surface pattern and is independent of the ink application step. Both perfect translational (x,y) registration and perfect skew registration are thereby achieved automatically between the different image elements making up the array, irrespective of their colour. As described further below, the surface pattern could comprise for example a surface relief structure or an arrangement of hydrophobic and hydrophilic areas. Techniques for forming such surface patterns with the necessary high resolution are known from flexographic and lithographic printing methods, for example.

It should be emphasised that the image application step by itself results in the plurality of inks being carried only on the ink-receptive elements of the surface pattern, and not also on the non-ink-receptive areas (although in practice a minor degree of spreading from the ink-receptive elements to the non-ink-receptive areas may occur, it is desirable to minimise this or prevent it as far as possible). For example, the inks may preferably be applied to the production tool from one or more ink application surfaces on which each ink is arranged in accordance with the desired first image. When the surface pattern on the production tool is brought into contact with the or each ink application surface, only the portions of the ink(s) contacted by the ink-receptive elements of the surface pattern become adhered to the production tool. The portions of the ink(s) corresponding to the non-ink-receptive elements of the surface pattern may remain behind on the ink application surface(s) or may temporarily transfer to the production tool but do not adhere (e.g. beading and running off the surface). Thus, no wiping or other ink-removal step need be performed on the production tool between the step in which the inks are applied to the surface pattern and the subsequent step of transferring the image elements on to the substrate, and preferably the method does not include such a step.

The plurality of inks forming the first image can be applied to the production tool simultaneously (e.g. from a single ink application surface on which they have been collected) or sequentially (e.g. each from a separate ink application surface). However, all of the plurality of inks will be transferred off the production tool and onto the substrate simultaneously, thereby achieving the desired high resolution image element array formed of multiple inks, in which the image elements are in perfect register with one another. As noted above, the production tool may either be brought into direct contact with the substrate, or the inks may be transferred onto the substrate via an intermediate transfer assembly such as a transfer blanket.

The substrate to which the image element array is transferred may be implemented in various different ways and in particular it should be noted that the image element array need not be applied directly to the surface of the substrate. There may instead be one or more pre-existing layers located on the substrate surface, on top of which the above method is performed, such as a primer layer and/or an existing image layer (termed the second image, below). The substrate may also be monolithic or could be multi-layered. In some embodiments, the substrate will be at least semi-transparent (i.e. visually clear, with low optical scattering, and preferably colourless but may carry a tint), but in other cases this is not necessary and the substrate could be translucent or even opaque. For example, the substrate could comprise a fibrous material such as paper.

In preferred embodiments, each of the plurality of inks is applied to the surface pattern in accordance with a respective image component representing the area(s) of the first image having a colour to which the ink contributes, at least two of the image components corresponding to different areas of the first image such that at least two of the plurality of inks are applied to different respective (e.g. laterally offset) areas of the surface pattern. For example, the first image may preferably be a "full colour" image such as a RGB, RGBK or CMYK print, formed of multiple print workings which need only be registered to one another to the extent necessary to form an acceptable multi-coloured image to the human eye (i.e. macro-registration, techniques for which are well established). The first image can be as complex or as basic as desired: the method will produce equally good quality results whether the first image is a full-colour, multi-tonal photographic image such as a portrait or, at the other end of the scale, a block pattern of various colours each covering a different macro-scale portion of the image.

In some particularly preferred embodiments, at least some of the ink-receptive elements individually receive two or more of the plurality of inks in respective laterally offset areas of the element, whereby at least some of the image elements in the image element array formed on the substrate are individually multi-coloured. That is, individual ones of the image elements themselves may be multi-coloured. This is extremely difficult or impossible to achieve with conventional printing techniques due to the difficulty in applying two inks in micro-registration with one another, but can be achieved straightforwardly using the presently disclosed method through the design of the first image and of the image array.

As indicated above, the production tool and its surface pattern can be implemented in various different ways. In a first preferred implementation, the surface pattern comprises a surface relief structure of elevations and depressions, the elevations forming the ink-receptive elements and the depressions forming the areas which are not ink-receptive, the production tool preferably comprising a flexographic printing plate or a dry lithographic printing plate. It should be noted that the terms "elevations" and "depressions" refer to the heights of the surface relief structure in such regions relative to one another, and not necessarily to the nominal plane of the production tool surface. Thus, for example, the "depressions" will be of lower height than the "elevations" but not necessarily lower than the original plane of the production tool surface. The surface of each elevation is preferably flat, i.e. of substantially constant height relative to the nominal plane of the production tool surface. For example, where the surface relief structure is arranged on a cylindrical surface, the surface of each elevation will be at a substantially constant radius from the centre of the cylinder.

In this implementation, the elevations of the surface relief structure receive the ink from the ink application surface(s) whereas the depressions do not, because only the elevations contact the ink on the application surface(s) during the image application step. As such, the material properties of the production tool surface can be the same in the depressions as on the elevations, i.e. the surface chemistry, is uniform across the production tool surface.

In a second preferred implementation, the surface pattern comprises an arrangement of hydrophilic and hydrophobic parts of the surface of the production tool, the hydrophobic parts forming the ink-receptive elements and the hydrophilic parts forming the areas which are not ink-receptive, the production tool preferably comprising a wet lithographic printing plate or a wet offset printing plate. Here, the terms "hydrophilic" and "hydrophobic" mean that the respective parts of the surface of the production tool have different surface energies from one another, which is typically achieved through chemical treatment. The hydrophilic parts are water-accepting and hence will not retain ink, whereas the hydrophobic parts are water-repelling and hence ink-accepting.

In this implementation, the method may include an additional step of dampening the surface pattern on the production tool with a fluid comprising water before the plurality of inks are applied to the production tool. The fluid forms a film on the hydrophilic areas and not on the hydrophobic areas. When the plurality of inks are applied in the form of the first image, the fluid film prevents the adhesion of the inks to the production tool surface in the hydrophilic (non-ink-receptive) areas but not in the hydrophobic (ink-receptive) elements.

In a variant of this implementation, the non-ink-receptive areas of the surface pattern could be formed by an ink-repellent material such as silicone, whilst the ink-receptive areas are formed of another material to which the inks will adhere. This approach is typically referred to as waterless offset printing or dry offset printing. Note in this variant the respective areas of the surface pattern need not be hydrophilic/hydrophobic and a dampening step is not essential. It is the difference in surface energy between the respective areas of the surface pattern which achieves the desired effect.

In all cases, it is preferred, but not essential, that the production tool takes the form of a cylinder with the surface pattern arranged about its circumference so that the method can be performed in a continuous, web-based process.

The first image can also be applied to the surface pattern on the production tool (whatever form it takes) in different ways. In a first preferred implementation, the multi-coloured first image is applied to the surface pattern by applying each of the plurality of inks to the production tool sequentially, in register with one another. For example, in this case each of the inks may be applied to the surface pattern directly from a respective, dedicated ink application surface, typically taking the form of a patterned tool, preferably a patterned lithographic printing plate, a patterned chablon plate, a patterned anilox roller or a patterned gravure roller. It should be noted that only macro-registration need be achieved between the different inks, i.e. to a level which will appear acceptable to the naked eye (e.g. to around 100 microns). Micro-registration is not required.

In a second preferred implementation, the multi-coloured first image is applied to the surface pattern by applying each of the plurality of inks to a collection surface in register with one another and then transferring the plurality of inks simultaneously from the collection surface onto the surface pattern. The collection surface may take the form of a blanket roller, for example. This collection surface then provides one ink application surface from which all of the plurality of inks are applied simultaneously directly onto the production tool. The inks will first be applied to the collection surface from respective, dedicated ink application surfaces, which may be of any of the types mentioned above. It should be noted that only macro-registration need be achieved between the different inks, i.e. to a level which will appear acceptable to the naked eye (e.g. to around 100 microns). Micro-registration is not required.

The first image could comprise any number of inks each with different optical characteristics. It should be noted that the differences in optical characteristics may or may not be visible to the human eye. Thus the term "multi-coloured" includes the case where the first image may appear monochromatic to the human eye (at least under some illumination conditions), but will have areas which give different responses either under other illumination conditions (e.g. UV) or when observed at non-visible wavelengths. For example two or more of the inks may have the same visible colour but different responses in a non-visible part of the spectrum, such as UV or IR. Also, one or more of the inks could have no visible colour but may emit in the non-visible spectrum, or could become visible under particular lighting conditions (e.g. UV illumination). Thus a "multicoloured" image is one made up of more than one ink with different optical characteristics, the inks being applied to different respective areas of the image (which may overlap). Nonetheless, preferably the plurality of inks includes at least two inks having different visible colours, most preferably three or four inks having different visible colours. For instance, the first image may comprise RGB, RGBK or CMYK components. To further enhance the security level, preferably, the plurality of inks includes at least one ink comprising a luminescent, phosphorescent, fluorescent, thermochromic, magnetic, optically variable, iridescent, pearlescent or metallic substance.

The plurality of inks could be conventional printing inks selected as appropriate to the nature of the surface pattern on the production tool. For example where the surface pattern is a surface relief pattern and the elevations define the image elements, the inks may be conventional flexographic inks. Flexographic inks are typically of relatively low viscosity, e.g. in the range 0.01 to 5 Pa·s at 23 degrees C., more preferably 0.01 to 2 Pa·s and still preferably 0.02 to 0.07 Pa·s. Where the surface pattern is defined by hydrophilic and hydrophobic areas, conventional lithographic or offset inks can be used. Typically these have a much higher viscosity, e.g. in the range 2 to 30 Pa·s. The inks may be dried using conventional methods. Alternatively, in preferred embodiments, one or more of the plurality of inks comprises a curable material and the method further comprises, after the image element array is formed on the substrate, curing the curable material, preferably by exposure to radiation. For example the one or more curable materials could be UV curable in which case the image element array may be cured by exposure to UV radiation. Curable inks can typically be cured faster than the drying of standard inks and hence the risk of ink spreading or smudging on the substrate is reduced.

As described above, the spatial layout of the surface pattern on the production tool will be designed to correspond to an image element array which will cooperate with an appropriate viewing element array to generate the described optically variable effect whereby, across a first region of the array, the first image will be displayed at a first range of viewing angles and not at a second range of viewing angles. In preferred embodiments this is achieved by arranging the surface pattern such that, in the first region of the image element array, the surface pattern is configured such that the image elements have substantially the same width as one another and are arranged periodically at least in the direction parallel to their width. The periodicity of the image elements should be substantially the same as that of the viewing element array, or a multiple thereof. In this way, the same region of the optical footprint of each viewing element (e.g. lens) will ultimately be occupied by the respective image elements, which gives rise to the required visual effect.

In some preferred implementations, in the first region of the image element array, the surface pattern is configured such that the image elements are elongate image elements, preferably parallel straight lines spaced periodically from one another in the direction orthogonal to their elongate direction. Such arrangements will result in a one-dimensional optically variable effect whereby the change in viewing angle must be about the axis parallel to the elongate direction of the image element in order to perceive the effect. This will be the case whether the image element array is combined with a viewing element array having one dimensional periodicity (e.g. a cylindrical lens array) or two dimensional periodicity (e.g. a spherical lens array).

In other preferred implementations, in the first region of the image element array, the surface pattern is configured such that the image elements are arranged in a periodic two-dimensional grid, preferably an orthogonal or hexagonal grid. For example, the image elements could be configured in a checkerboard arrangement. The individual image elements could be dots, squares, circles, hexagons or any other appropriate shape. Such arrangements can be used to obtain a two-dimensional optically variable effect whereby changes in viewing angle about any axis lying in the plane of the image array will give rise to the desired effect, provided the image element array is combined with a viewing element array also having two-dimensional periodicity.

Preferably, the surface pattern is configured such that the individual image elements are 100 microns or less in at least one dimension, preferably 50 microns or less, more preferably 30 microns or less. For instance, in the case of line elements this dimension represents the width of the lines, and in the case of dot-shaped or other similar shapes of element this represents their diameter or equivalent measurement. The smaller the image elements, the greater the number of "channels" (i.e. different appearances) which the lenticular-type device can display across the full range of viewing angles.

Various different visual effects can be achieved based on the above-described principles through appropriate design of the image element array defined by the surface pattern on the production tool. In some preferred examples, the first region encompasses substantially the whole of the image element array whereby the first image is displayed across substantially the whole of the image element array at the first range of viewing angles and at the second range of viewing angles the first image is substantially hidden. The finished security device will then provide a two-way "switch" effect between a state in which the first image is visible across the device and another state in which it is no longer visible (a second, different image may be displayed instead or the device may appear "blank"). This may be particularly desirable where the first image is a complex image such as a photograph, e.g. a portrait.

More sophisticated visual effects can be achieved where the image element array further comprises a second region in which the image elements are configured such that the first image will be displayed over a different range of viewing angles from that over which the first image is displayed in the first region of the image element array. Preferably, in the second region the surface pattern is configured such that the image elements have substantially the same width as one another and are arranged periodically at least in the direction parallel to their width, the periodicity (and optionally the width) being substantially the same as in the first region but the image elements being spatially offset in the second region relative to those in the first region. The second region is a different region of the image element array from the first region but it may optionally overlap the first region (in which case the peripheries of the two regions will be different from one another—that is, there will be at least some of the first region or of the second region which is not overlapped by the other). In this way, different regions of the first image will be displayed by the finished device at different viewing angles. This appears to the viewer as if different images are being displayed at different viewing angles, although in fact they are provided by the same (first) image. For example, the first and/or second region may preferably have a periphery which defines an item of information, such as one or more alphanumeric characters, geometric shapes, symbols, currency signs, logos, or images. As an example, the periphery of the first region could define the digit "5" whilst that of the second region defines a star-shaped symbol. At viewing angles at which the first region displays the first image, the device will have the appearance of the digit "5" filled in by the first image (e.g. a multi-coloured pattern), whilst at other viewing angles where the second region displays the first image, the device will have the appearance of a star filled in by the first image.

If the first and second regions overlap, the digit "5" and the star (or other shapes, depending on the regions' peripheries) will appear at approximately the same location on the device and some of the portions of the first image revealed in each region will be the same (i.e. common to both regions). Alternatively the first and second regions may be non-overlapping (e.g. adjacent, abutting one another or spaced apart), in which case each will reveal different, laterally offset portions of the first image. In this latter case, the first and second regions of the image element array may advantageously be configured such that each corresponds approximately to areas of different respective colour in the first image, such that substantially all the image elements in the first region are different in colour from substantially all the image elements in the second region, whereby the colour of the first image appears to change upon changing the viewing angle. The elements within each region could still be multi-coloured, e.g. red and blue in the first region, and black and white in the second region.

Still more complex effects can be achieved by providing more regions of the device. Thus, preferably, the image element array further comprises a third and optionally additional regions in each of which the surface pattern is configured such that the image elements are such that the first image will be displayed over a different range of viewing angles from that over which the first image is displayed in the other regions of the image element array. Advantageously, the regions are configured to give the appearance of an animation effect as the different regions display the first image upon changing the viewing angle. For example, the regions may all be of the same size and shape but arranged at laterally offset positions so that the revealed part of the first image appears to move across the device upon tilting. Alternatively the regions may be of different sizes and/or shapes to one another and configured to give the impression of expansion or contraction, or morphing from one shape into another upon tilting. A combination of the two approaches is also possible. It will be appreciated that all of these effects can be achieved through design of the image element array defined by the surface pattern on the production tool, which combined with the multi-coloured first image can be used to achieve new and highly complex visual effects which have not previously been feasible.

In many implementations, there is no need for any registration between the first image and the surface pattern on the production tool. For example, this is particularly the case where the image element array is uniform across its whole area (i.e. consists of a single region). This is desirable in terms of ease of manufacture. However, in other cases it is preferred that the multi-coloured first image is applied to the production tool in register with the surface pattern. For instance, this will be necessary if a particular correspondence between different regions of the image element array and the first image is desired, e.g. different colour areas of the first image corresponding to different regions of the array. Nonetheless, only macro-registration (e.g. to 100 microns) will be required.

As mentioned above, the multi-coloured first image could take any desirable form, e.g. an abstract pattern of two or more colours, alphanumeric text or symbols in multiple colours or a graphic representation of an object or logo in two or more colours, multi-tonal images such as portraits, or photographic images. If it is desired that certain colours in the image correspond to different region of the image array, as mentioned above, then the image should be designed accordingly with sufficiently large regions of each colour such that macro-level registration is adequate to ensure that each of those colours will be applied to the desired region of the image element array on the surface pattern (or at least a majority of that region, taking into account a degree of misregistration). For instance each such region should preferably have minimum dimensions no less than 100 microns, more preferably 500 microns. In other implementations where the correspondence between colours of the image and regions of the array is not required, there are no constraints on the arrangement of colours in the image. For example a complex arrangement of interspersed coloured pixels can be used, as in a full colour photographic image for instance. In all cases, the first image could be screened or half-toned.

The appearance of the security device can advantageously be further enhanced by providing a second image overlapping at least part of the image element array such that elements of the second image are exposed through the gaps between the elements of the first image, whereby the elements of both images can be viewed from the same side of the image array. In this way, when a viewing element array is provided, at viewing angles at which the first region does not display the first image, the second image will instead be displayed in the first region. Hence the appearance of the first region will appear to switch between the first image and the second image as the viewing angle is changed. The second image could be a uniform block of colour, or could be a monochromatic image or a multi-coloured image with any level of complexity.

The second image can be formed by any convenient technique but most preferably by printing the second image, advantageously in more than one print working. As in the case of the first image, the present method avoids the need for the second image to be printed with a particularly high resolution technique. Any print method including inkjet, laser printing, lithographic printing, gravure printing, flexographic printing, D2T2, or letterpress can be used. The second image can also be screened or half-toned. Alternatively the second image could be a metallic layer, such as an all-over or patterned metallisation.

It will be noted that the second image could be provided at any point during the aforementioned method (i.e. before or after application of the image element array to the substrate), provided that its resulting location is as specified. The second image should preferably be different from the first image (at least in some noticeable attribute, e.g. content, colour, pattern of colours, size or a change in position/orientation) so that the first image elements can be visually distinguished from the second image elements (i.e. those parts of the second image visible through the gaps in the image element array). Importantly, there is no need to register the second image to the first image elements.

Hence in one preferred implementation, the second image is provided on a first surface of the substrate and the image element array is subsequently transferred on top of the second image on the first surface of the first substrate. Alternatively the image element array is transferred onto a first surface of the substrate and the second image is provided on a second surface of the substrate, the substrate being at least semi-transparent. In another option the image element array is transferred onto a first substrate and the second image is provided on a second substrate, to which the first substrate is affixed, the first and/or second substrate being at least semi-transparent. The substrates may be affixed by adhesive and/or lamination for example, and the resulting bond may be temporary or permanent. Whilst at least one of the substrates must be at least semi-transparent (as defined previously), the other may be translucent or opaque. The second substrate could for example be a document substrate forming the basis of a security document such as a banknote, e.g. paper, polymer or a hybrid thereof.

In order to avoid any parallax effects existing between the first and second images, it is desirable to place the first and second images as close together as possible, preferably on the same plane as one another. Hence advantageously, the second image either contacts the image element array or is spaced from the image element array by 15 microns or less, preferably 10 microns or less, still preferably 5 microns or less. For instance where the second image is applied to the opposite side of the substrate from the image element array, the substrate is desirably as thin as possible so that the two image planes are closely adjacent one another.

The substrate to which the image element array is applied could be configured to form the basis of a security article, such as a security thread, strip, foil or patch, or of a security document, such as a banknote, passport or identity card. In both cases the substrate is preferably polymeric and desirably at least semi-transparent. For example the substrate may comprise polypropylene (most preferably BOPP), polycarbonate, polyethylene, PVC or similar. In the case of a security article the thickness of the substrate will typically be less than that of substrates suitable for use as document substrate, e.g. between 20 and 50 microns as compared with between 60 and 150 micron.

The invention further provides an image element array manufactured in accordance with the methods described above.

Also provided is a method of manufacturing a security device, comprising:

(i) manufacturing an image element array using any of the methods set out above; and (ii) providing a viewing element array overlapping the image element array;

wherein the image element array and viewing element array are configured to co-operate such that each viewing element within a first region of the image element array directs light from a respective one of the image elements or from a respective one of the gaps between the image elements in dependence on the viewing angle, whereby depending on the viewing angle the viewing element array in the first region directs light from either the array of image elements or from the gaps therebetween, such that upon changing the viewing angle, the first image is displayed by the image elements in combination across the first region of the image element array at a first range of viewing angles and not at a second range of viewing angles.

As already described, the resulting security device displays an optically variable effect based on the lenticular device principle of interlaced image elements.

It will be appreciated that the manufacture of the security device may take place as part of the same process as manufacturing the image element array, or could be performed separately, e.g. by a different entity. The viewing element array could be provided before or after the image element array is formed. The viewing element array may be applied onto the substrate which carries the image element array, either on the same surface as that on which the image elements are formed, or on the opposite surface. Alternatively the viewing element array could be provided on another (at least semi-transparent) substrate to which the substrate carrying the image element array is affixed. Preferably, the viewing element array is applied to the same substrate as that carrying the image element array, most preferably on the opposite surface of the substrate from that which carries the image element array, before or after the image element array is transferred onto the substrate.

At least in the first region, the viewing element array is advantageously periodic in at least one dimension and, preferably, the periodicity of the viewing element array is substantially equal to or a multiple of that of the image elements in the first and/or second region. Advantageously, the viewing element array is registered to the image element array at least in terms of orientation and preferably also in terms of translation. The latter is not required unless it is desired to ensure that the first image is displayed by the first region at a particular range of viewing angles.

The optically variable effect exhibited by the security device may be exhibited upon tilting the device just one direction (i.e. a one-dimensional optically variable effect), or in other preferred implementations may be exhibited upon tilting the device in either of two orthogonal directions (i.e. a two-dimensional optically variable effect). Thus, the viewing element array may have one or two dimensional periodicity (although to obtain a two dimensional optically variable effect an image element array with two dimensional periodicity will also be required). In preferred examples, the viewing element array has a one- or two-dimensional periodicity in the range 5-200 microns, preferably 10-70 microns, most preferably 20-40 microns.

The viewing component array could comprise a masking grid of apertures (e.g. lines or dots) in an otherwise opaque layer. For instance, a suitable masking grid could be formed of a metal layer spaced from the image element array by a transparent layer, the metal layer having apertures defined therein as required to generate the desired visual effect, e.g. by etching or another demetallisation process. Alternatively the masking grid could be printed, e.g. using a metallic or other substantially opaque ink. In such cases the optically variable effect may be visible when the device is viewed in transmission (i.e. against a backlight) rather than reflected light.

In particularly preferred embodiments, the viewing element array is a focussing element array, the focussing elements preferably comprising lenses or mirrors. The so-produced security device is a lenticular device. Again the effect can be one dimensional or two dimensional, so advantageously the focussing element array comprises focusing elements adapted to focus light in one dimension, preferably cylindrical focusing elements, or adapted to focus light in at least two orthogonal directions, preferably spherical or aspherical focussing elements. The focusing elements may be formed by a process of thermal embossing or cast-cure replication, for example.

In order for the security device to generate a focused image, preferably at least the image element is located approximately in the focal plane of the focusing element array, and if a second image is provided, the second image elements are preferably also located approximately in the focal plane of the focusing element array. It is desirable that the focal length of each focussing element should be substantially the same, preferably to within +/−10 microns, more preferably +/−5 microns, for all viewing angles along the direction(s) in which it is capable of focussing light.

The present invention further provides a security device manufactured in accordance with the above method.

The invention also provides a security article comprising a security device as described above, wherein the security article is preferably a security thread, strip, foil, insert, transfer element, label or patch.

Also provided is a security document comprising a security device or a security article, each as described above, wherein the security document is preferably a banknote, cheque, passport, identity card, driver's licence, certificate of authenticity, fiscal stamp or other document for securing value or personal identity. The security device could be manufactured directly on the substrate of the security document or on one or more other substrates which are applied to or incorporated into the document. For example, in a document with a transparent (e.g. polymer) substrate, such as a polymer banknote, the image element array could be formed on one side of the document substrate, or on another substrate which is then laminated to it, and the viewing element array could be applied to the other side of the document substrate. The device can be positioned in a full window region or in a half window region of the document. In a document with a conventional paper substrate the security device could be formed on a thread, stripe or patch and incorporated into or onto the document, e.g. as a windowed thread or via hot stamping or adhesive. The image element array could be applied to such a security article before or after it is incorporated into or onto the document. In still further examples, the substrate could be non-transparent, e.g. formed of paper, such as the substrate of a conventional banknote, or a region of a polymer banknote covered by an opacifying layer. After application of the image element array thereto using the above method, a transparent optical spacing layer can be applied over the image element array, and a viewing element array positioned on the spacer layer.

In accordance with another aspect of the invention, a method of manufacturing an image element array for an optically variable security device, comprises:

providing a production tool having a surface pattern of ink-receptive elements spaced by areas which are not ink-receptive, the ink-receptive elements defining the image elements of the desired image element array;

applying a multi-coloured first image formed of a plurality of inks to only the ink-receptive elements of the surface pattern and not to the areas in between;

transferring only the portions of the multi-coloured first image corresponding to the image elements of the desired image element array from the production tool to a substrate, by bringing the plurality of inks on the surface pattern into contact with the substrate or with a transfer assembly which then contacts the substrate, whereby an image element array is formed on the substrate;

wherein the surface pattern on the production tool is configured such that the image elements have substantially the same width as one another and are arranged periodically at least in the direction parallel to their width, spaced by gaps therebetween.

The resulting image element array is therefore suitable for use in a security device such as a lenticular device, and all the same advantages as those discussed above with respect to the preceding aspects of the invention are achieved. Likewise, any of the preferred features mentioned above in connection with the preceding aspects of the invention can be applied to the present aspect.

This aspect of the invention also provides a method of manufacturing a security device, comprising:

(i) manufacturing an image element array using the above method; and (ii) providing a viewing element array overlapping the image element array;

wherein the image element array and viewing element array are configured to co-operate such that each viewing element within a first region of the image element array directs light from a respective one of the image elements or from a respective one of the gaps between the image elements in dependence on the viewing angle, whereby depending on the viewing angle the viewing element array in the first region directs light from either the array of image elements or from the gaps therebetween, such that upon changing the viewing angle, the first image is displayed by the image elements in combination across the first region of the image element array at a first range of viewing angles and not at a second range of viewing angles.

Again, any of the preferred features of the preceding aspect of the invention can be applied to this method.

Exemplary methods of manufacturing image element arrays and security devices, in accordance with the present invention will now be described and contrasted with conventional methods, with reference to the accompanying drawings, in which.

Figure 4A:
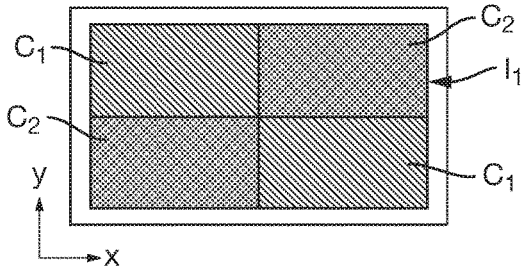
FIG. 4 depicts a method of manufacturing an image element array in accordance with a first embodiment of the present invention, FIG. 4(*a*) showing an exemplary first image, FIG. 4(*b*) showing the desired image element array and FIG. 4(*c*) illustrating exemplary apparatus used to manufacture the image element array and the resulting product.
Figure 4B:
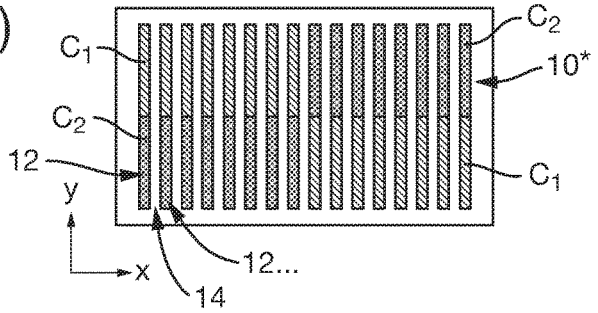
Figure 4C:
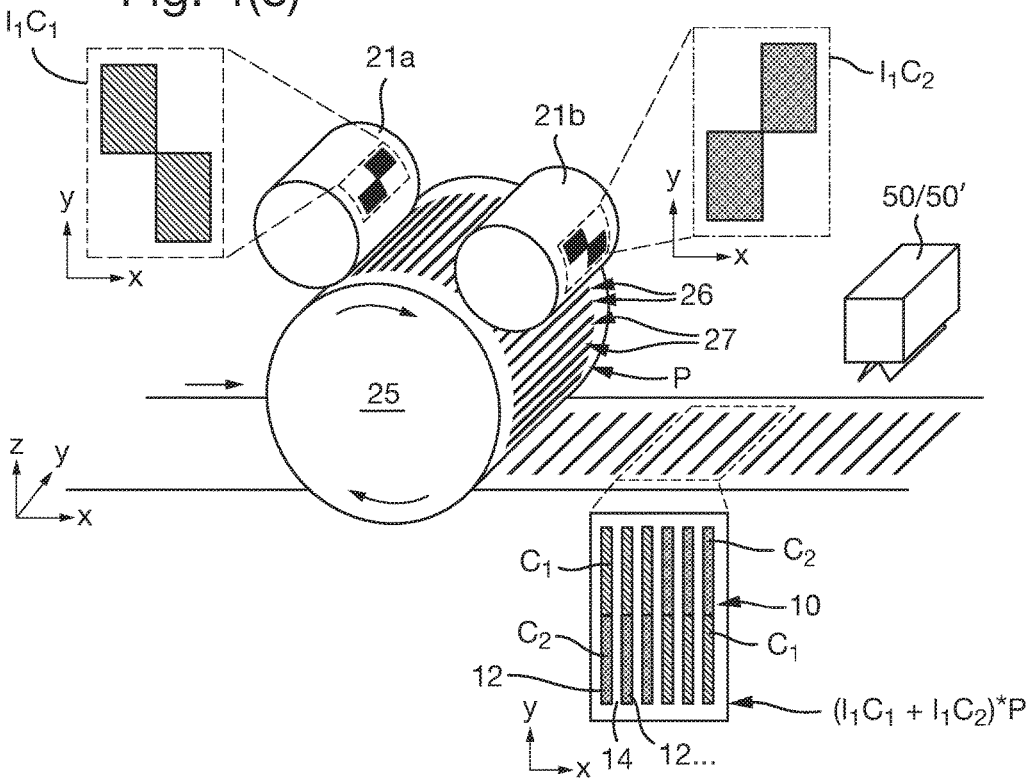
Figure 6:
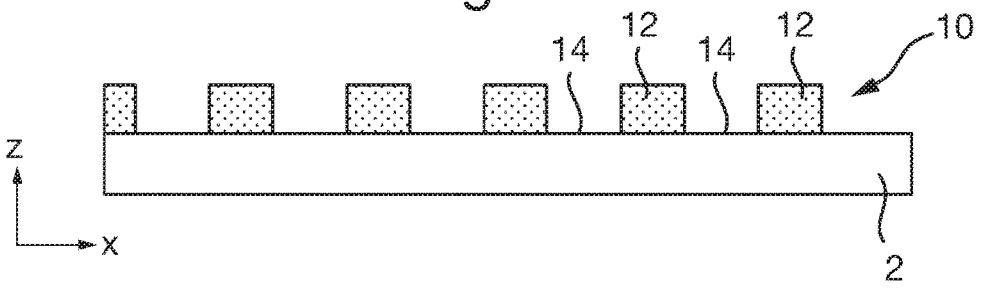
FIG. 6 shows an exemplary image element array produced by the method of FIG. 4, in cross-section.
Figure 7A:
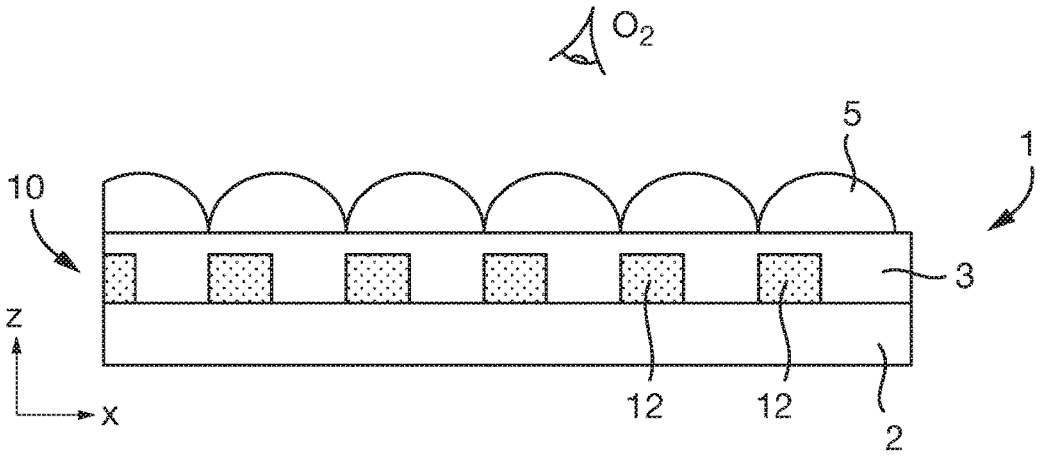
Figure 7B:
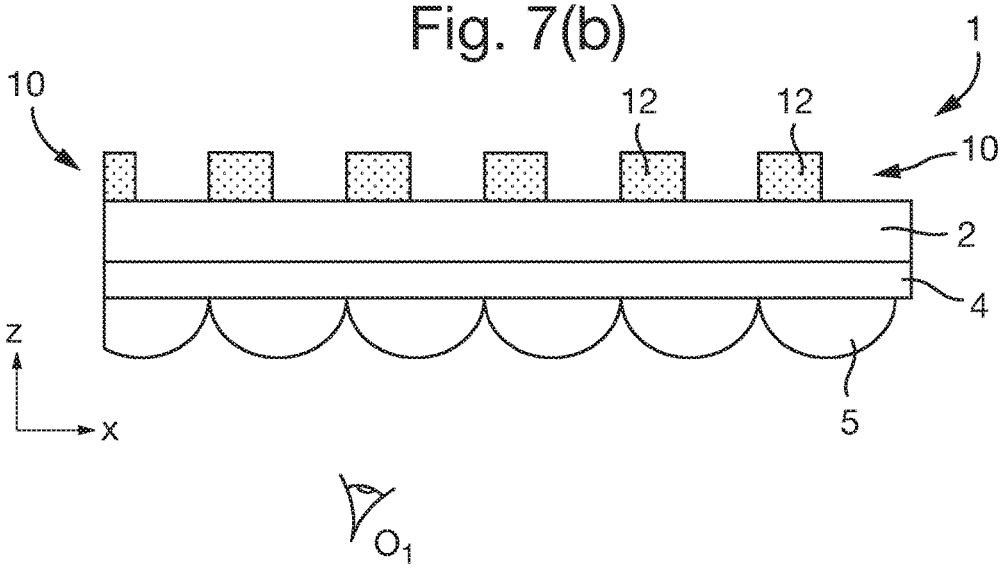
Figure 19A:
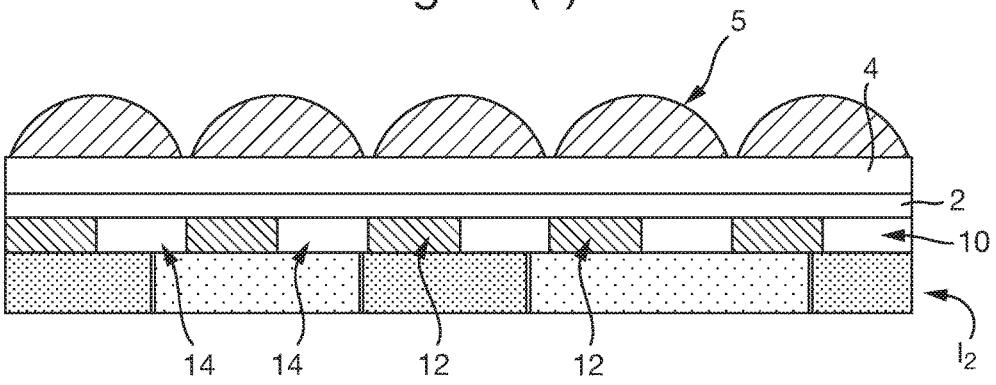
Figure 19B:
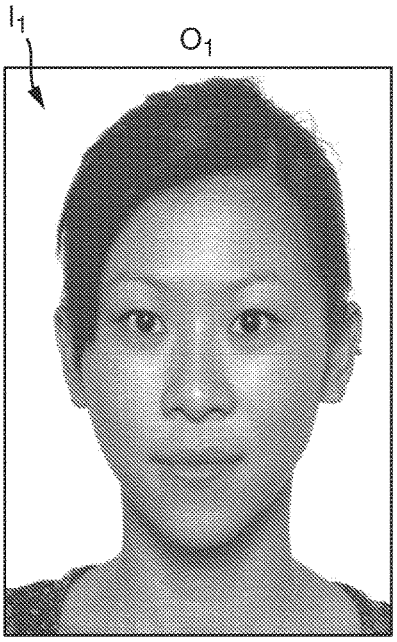
Figure 19C:
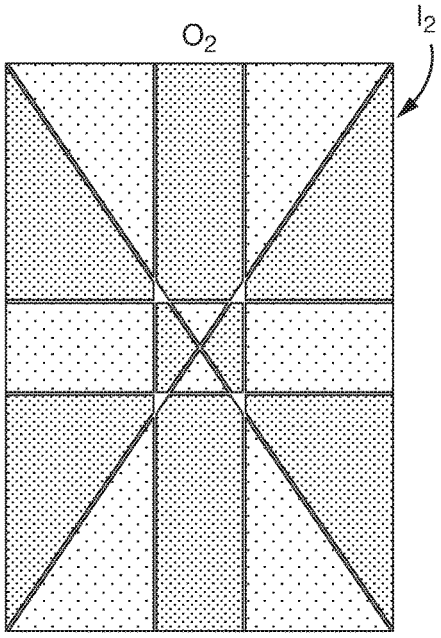
Figure 20A:
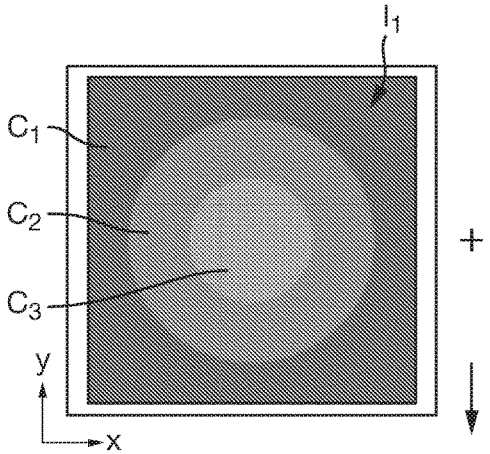
Figure 20B:
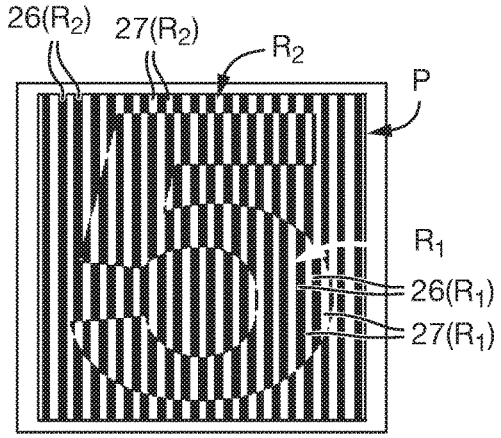
Figure 20C:
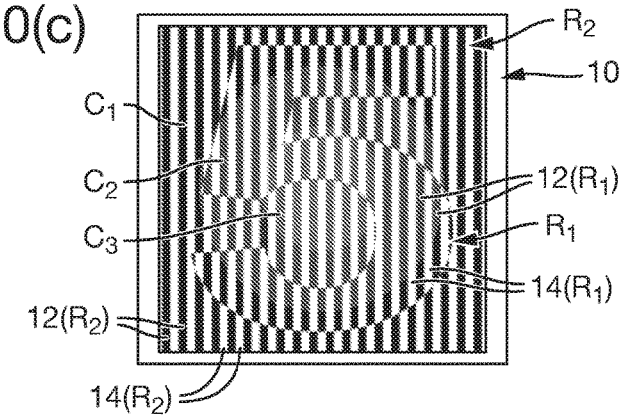
Figure 21A:
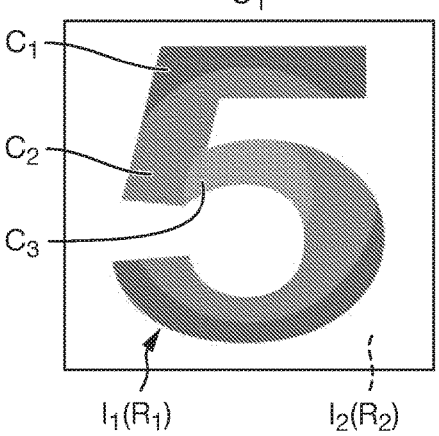
Figure 21B:
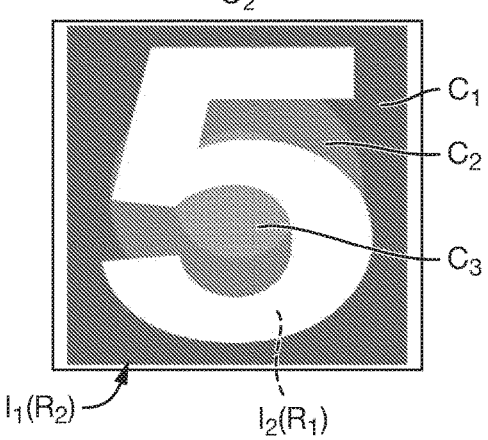
Figure 22A:
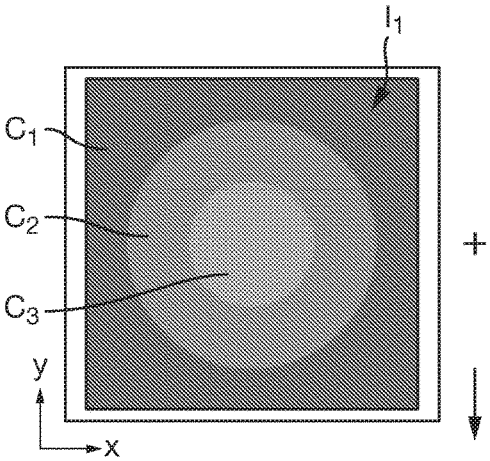
Figure 22B:
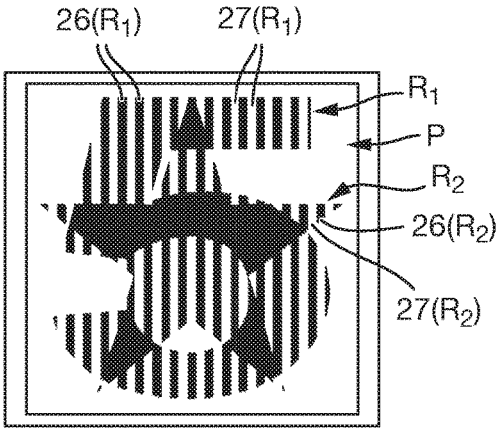
Figure 22C:
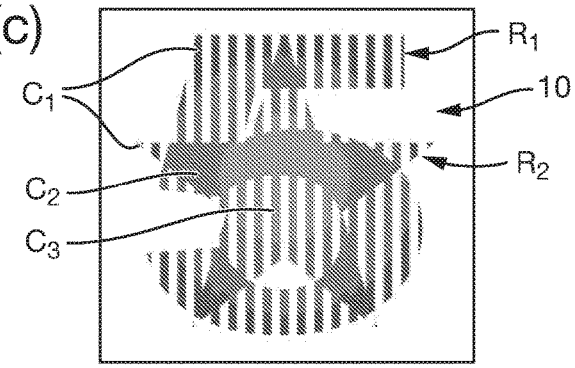
Figure 23A:
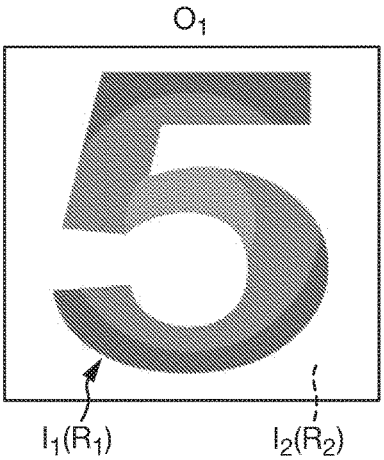
Figure 23B:
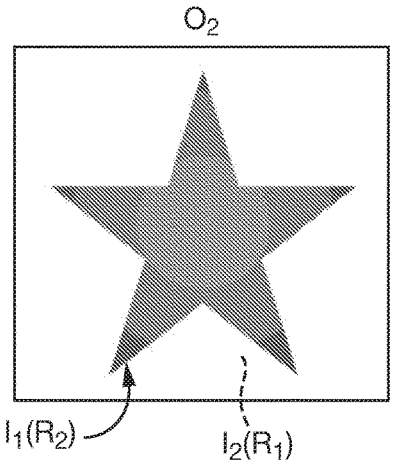
Figure 24A:
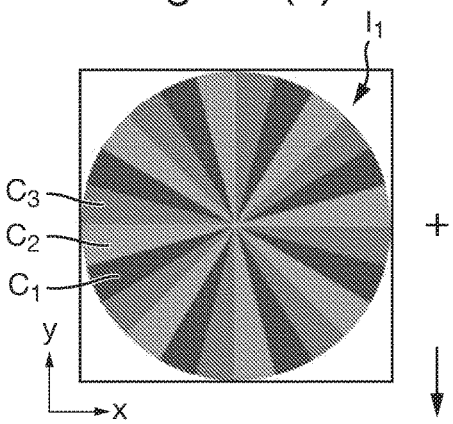
Figure 24B:
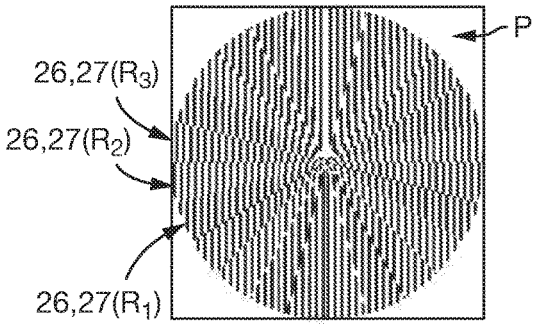
Figure 24C:
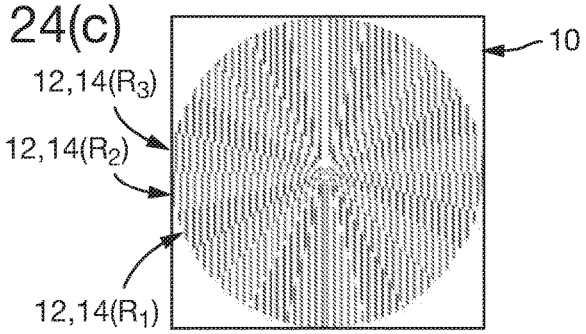
Figure 25A:
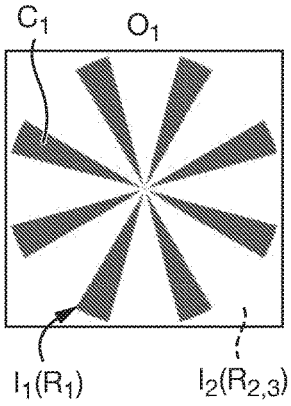
Figure 25B:
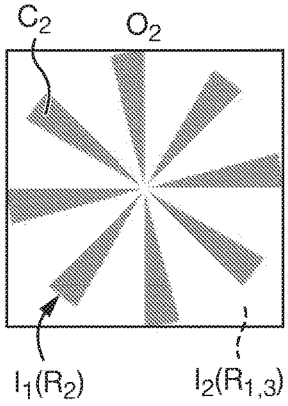
Figure 25C:
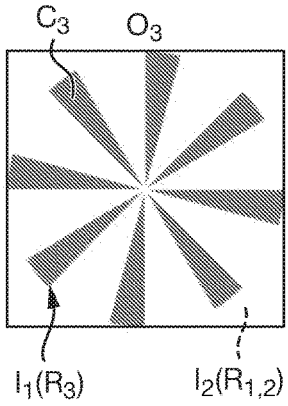
Figure 26A:
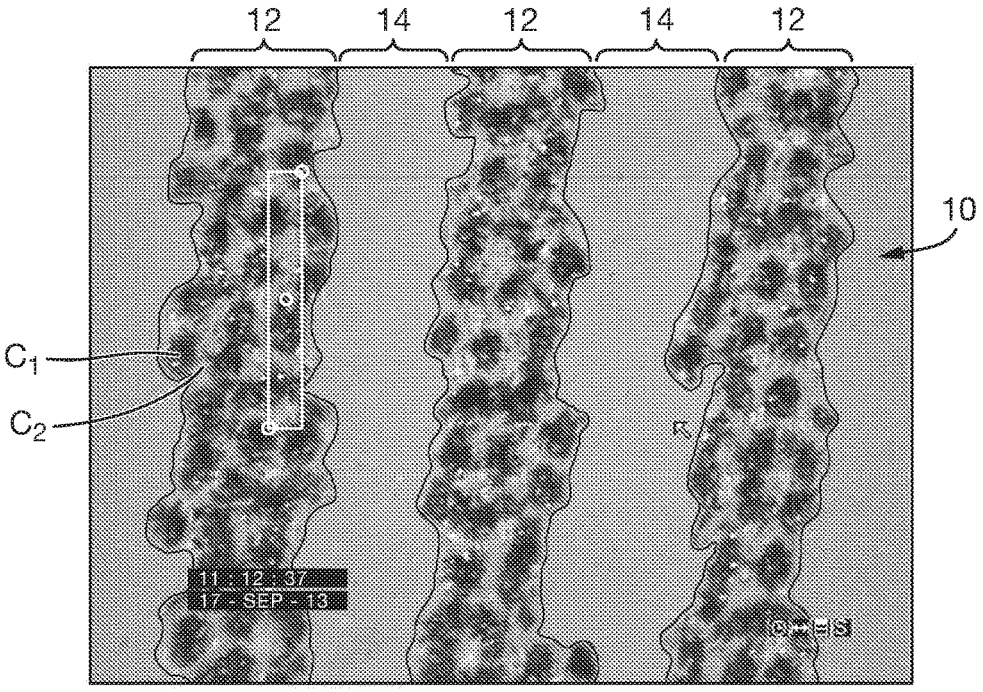
Figure 26B:
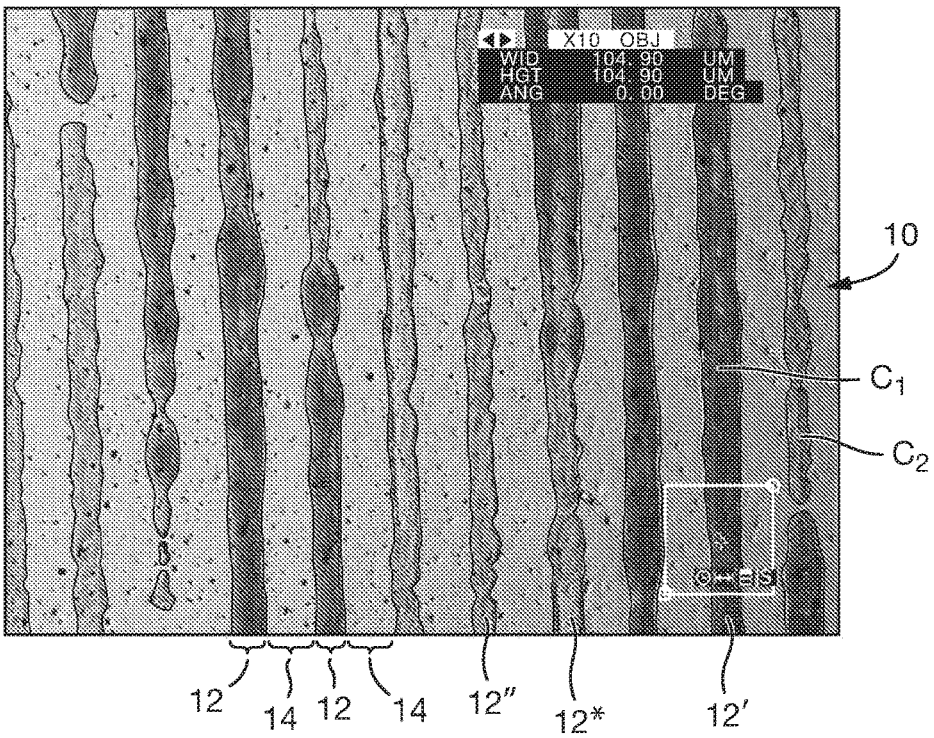
Figure 27A:
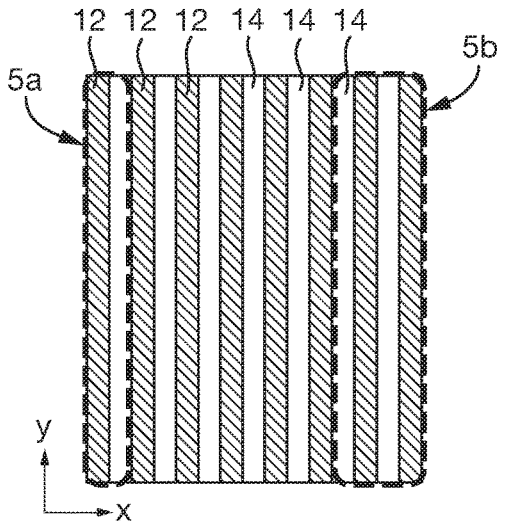
Figure 27B:
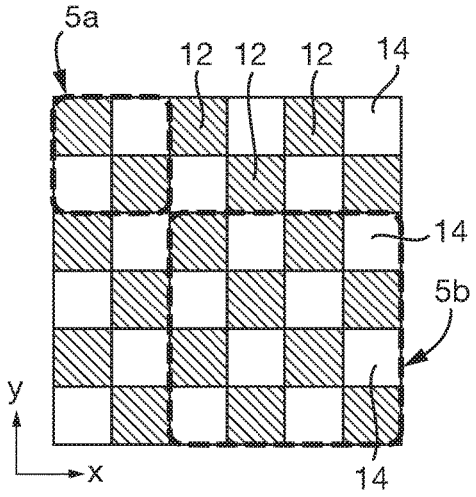
Figure 27C:
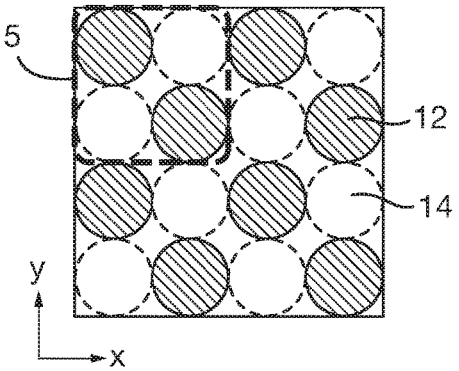
Figure 27D:
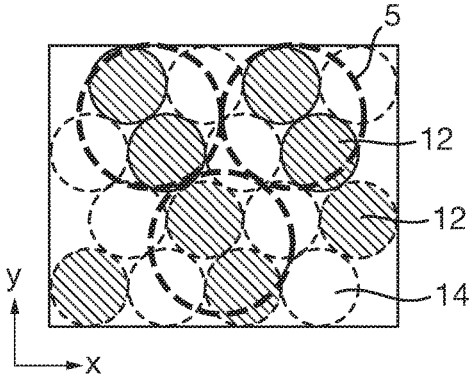
Figure 28:
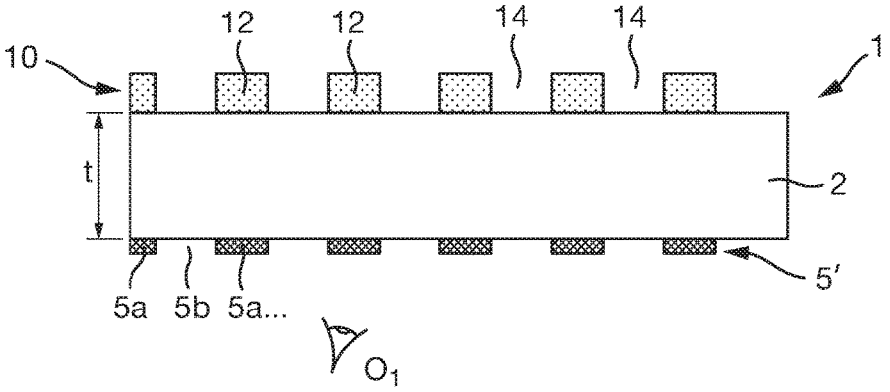
Figure 29:
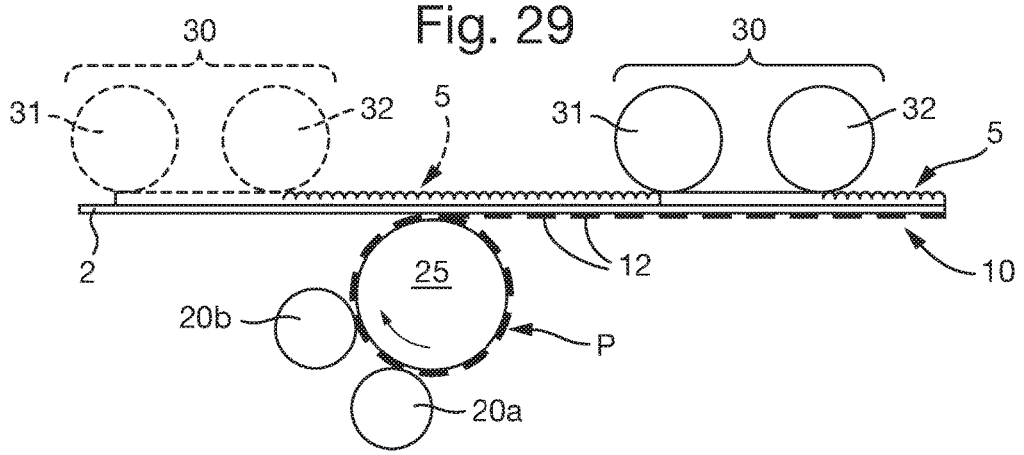
Figure 30:
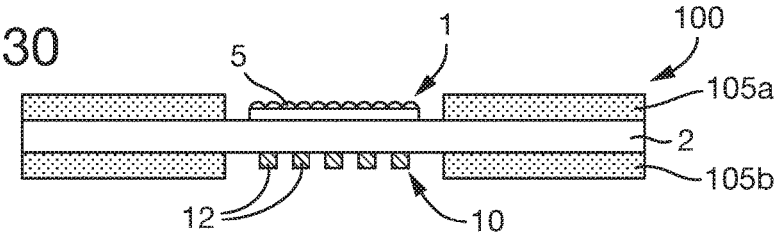
Figure 31:
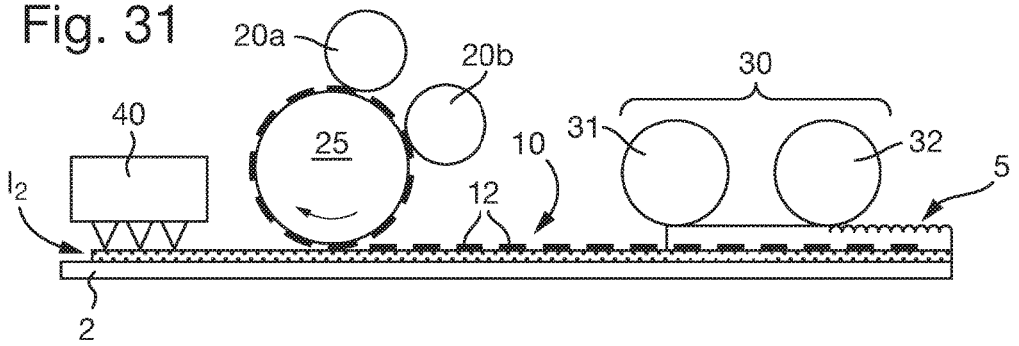
Figure 32A:
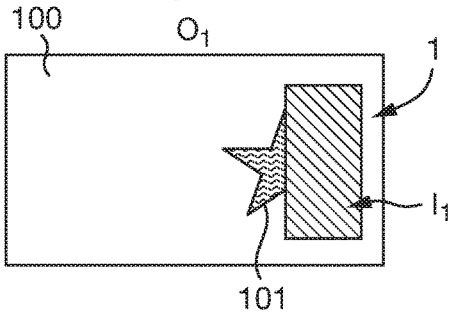
Figure 32B:
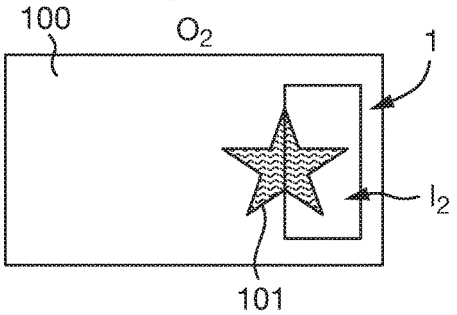
Figure 33A:
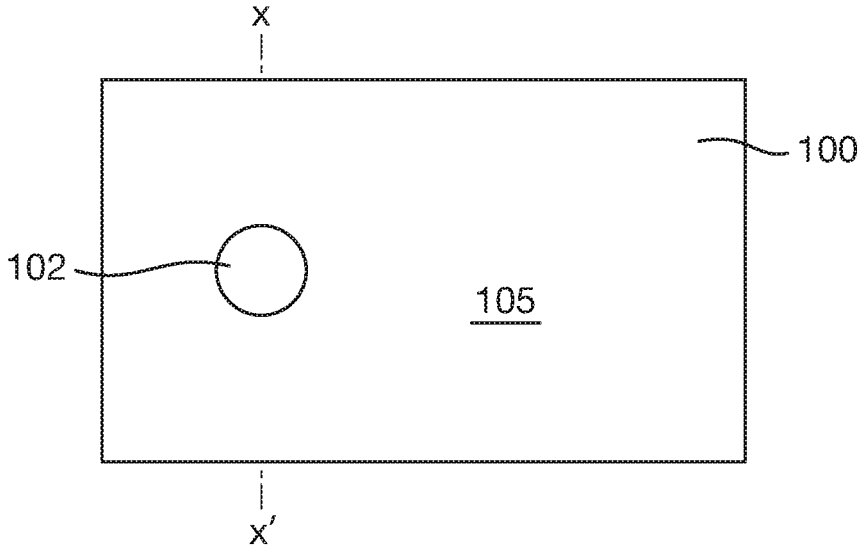
Figure 33B:
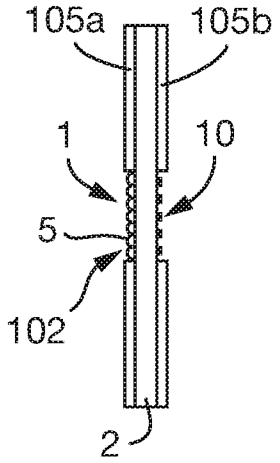
Figure 33C:
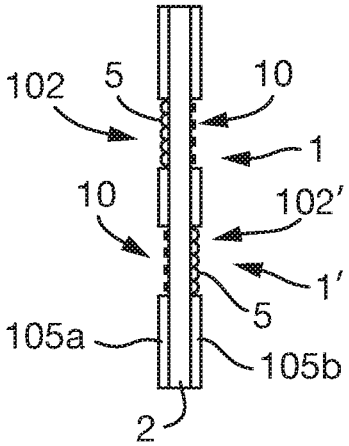
Figure 34A:
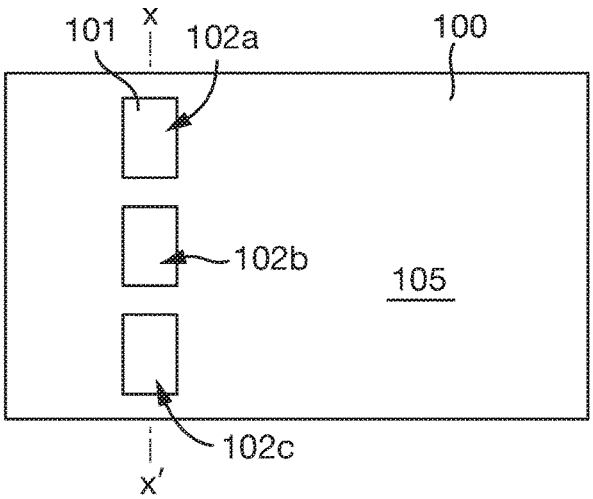
Figure 34B:
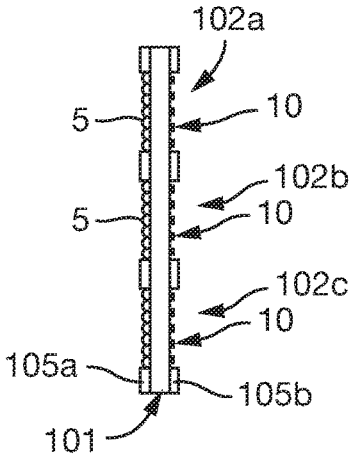
Figure 35A:
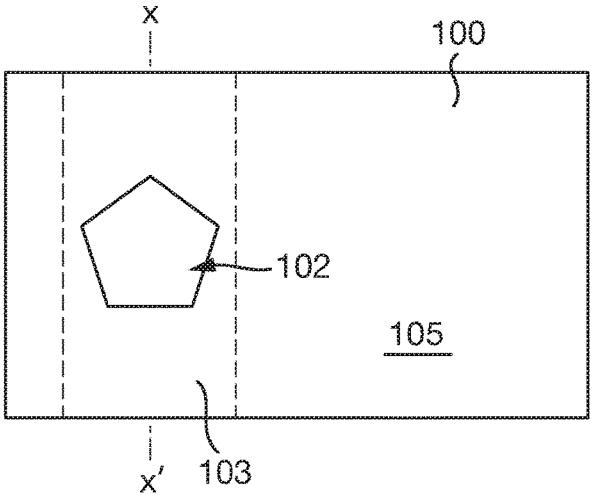
Figure 35B:
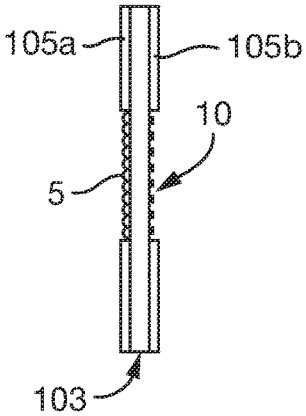
Figure 36A:
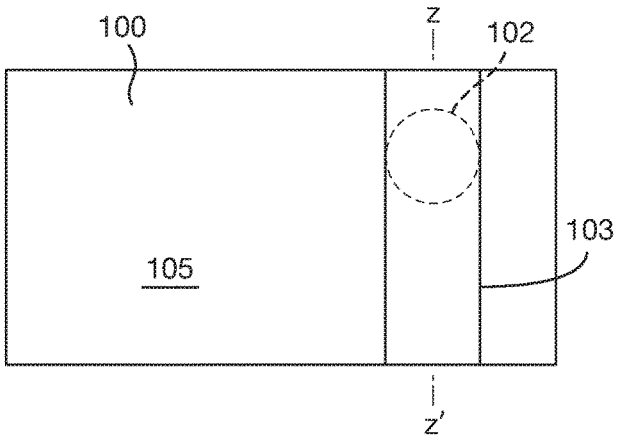
Figure 36B:
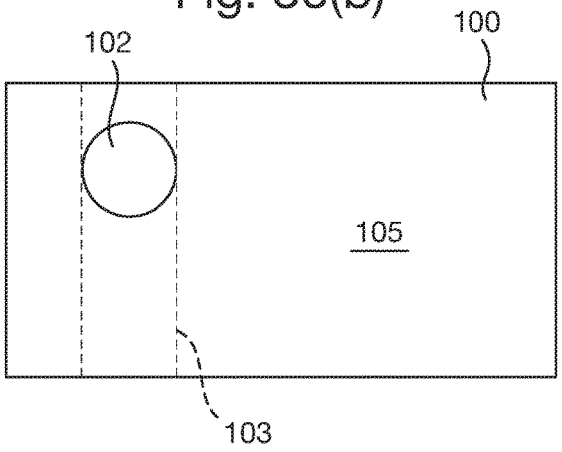
Figure 36C:
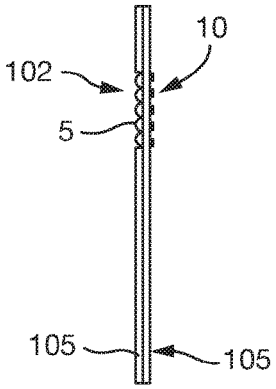

FIGS. 7*a* and 7*b* show two embodiments of security devices incorporating the image element array of FIG. 6;

FIGS. 8 to 11 show four further exemplary image element arrays produced by variants of the FIG. 4 method;

FIGS. 12 to 15 schematically depict exemplary apparatus used to manufacture image element arrays in accordance with second, third, fourth and fifth embodiments of the invention;

FIG. 16 shows exemplary artwork used in an embodiment of the invention, FIG. 16(*a*) depicting an exemplary first image, FIGS. 16(*b*) and (*c*) depicting first and second colour plates derived from the first image, FIG. 16(*d*) illustrating the reconstituted first image, FIG. 16(*e*) showing an exemplary surface pattern, FIG. 16(*f*) depicting the resulting image element array; and FIGS. 16(*g*) and (*h*) showing the appearance of an exemplary security device incorporating the image element array of FIG. 16(*f*), from two different viewing angles;

FIG. 17 shows exemplary artwork used in another embodiment of the invention, FIG. 17(*a*) depicting an exemplary first image, FIGS. 17(*b*) and (*c*) depicting first and second colour plates derived from the first image, FIG. 17(*d*) illustrating the reconstituted first image, FIG. 17(*e*) showing an exemplary surface pattern, FIG. 17(*f*) depicting the resulting image element array; and FIGS. 17(*g*) and (*h*) showing the appearance of an exemplary security device incorporating the image element array of FIG. 17(*f*), from two different viewing angles;

FIG. 18 shows exemplary artwork used in an embodiment of the invention, FIG. 18(*a*) depicting an exemplary first image, FIG. 18(*b*) depicting an exemplary surface pattern, FIG. 18(*c*) depicting the resulting image element array and FIGS. 18(*d*) and (*e*) showing the appearance of an exemplary security device incorporating the image element array of FIG. 18(*c*), from two different viewing angles;

FIG. 19 shows a variant of the FIG. 18 embodiment, FIG. 19(*a*) showing the exemplary security device in cross-section and FIGS. 19(*b*) and (*c*) showing the appearance of the device from two different viewing angles;

FIG. 20 shows exemplary artwork used in an embodiment of the invention, FIG. 20(*a*) depicting an exemplary first image, FIG. 20(*b*) depicting an exemplary surface pattern, and FIG. 20(*c*) depicting the resulting image element array;

FIGS. 21(*a*) and (*b*) show the appearance of an exemplary security device incorporating the image element array of FIG. 20(*c*), from two different viewing angles;

FIG. 22 shows exemplary artwork used in an embodiment of the invention, FIG. 22(*a*) depicting an exemplary first image, FIG. 22(*b*) depicting an exemplary surface pattern, and FIG. 22(*c*) depicting the resulting image element array;

FIGS. 23(*a*) and (*b*) show the appearance of an exemplary security device incorporating the image element array of FIG. 22(*c*), from two different viewing angles;

FIG. 24 shows exemplary artwork used in an embodiment of the invention, FIG. 24(*a*) depicting an exemplary first image, FIG. 24(*b*) depicting an exemplary surface pattern, and FIG. 24(*c*) depicting the resulting image element array;

FIGS. 25(*a*), (*b*) and (*c*) show the appearance of an exemplary security device incorporating the image element array of FIG. 24(*c*), from three different viewing angles;

FIGS. 26(*a*) and (*b*) are photographs depicting enlarged portions of two exemplary image element arrays;

FIGS. 27(*a*) to (*d*) show four exemplary patterns according to which an image element array may be formed, in plan view;

FIG. 28 shows a further example of a security device in which image element arrays made in accordance with embodiments of the invention may be incorporated, in cross-section;

FIG. 29 shows an embodiment of apparatus for manufacturing an security device;

FIG. 30 shows an exemplary security document with an exemplary security device as may be manufactured by the apparatus of FIG. 29, in cross section;

FIG. 31 shows another embodiment of apparatus for manufacturing a security device;

FIGS. 32(*a*) and (*b*) show an exemplary security document with an exemplary security device as may be manufactured by the apparatus of FIG. 31, in plan view from two different viewing angles;

FIGS. 33, 34 and 35 show three exemplary security documents carrying security devices made in accordance with embodiments of the present invention (a) in plan view, and (b)/(c) in cross-section; and FIG. 36 illustrates a further embodiment of a security document carrying a security device made in accordance with the present invention, (a) in front view, (b) in back view and (c) in cross-section.

The description below will concentrate, in the main part, on image element arrays used in lenticular security devices, i.e. where the image element array is combined with an array of focussing elements to achieve an optically variable effect. However as mentioned above the same type of image element array can alternatively be combined with other types of viewing element arrays, such as masking grids, to achieve similar optically variable effects, and an example of such a device will be provided below with reference to FIG. 28. In both cases, the image element array comprises a series of image elements, each carrying a portion of a corresponding image.

Figure 1A:
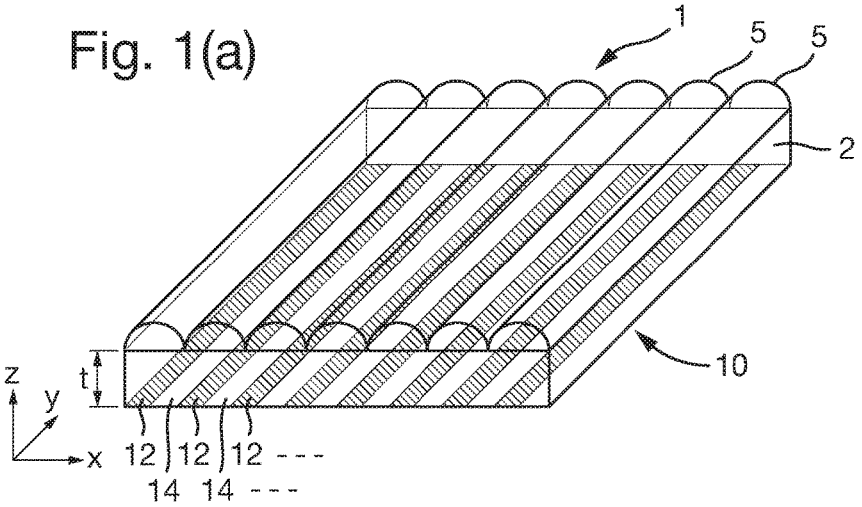
FIG. 1 shows an exemplary security device having an image element array which can be formed using methods in accordance with the present invention, in (a) perspective view, (b) cross-section, and (c) plan view from two different viewing angles.
Figure 1B:
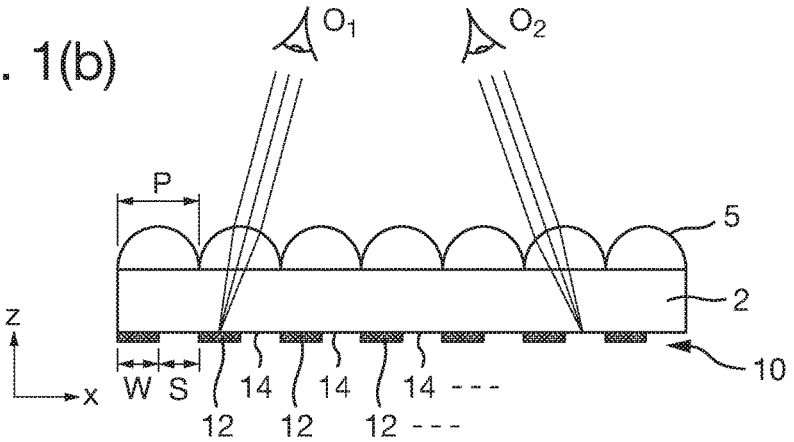
Figure 1C:
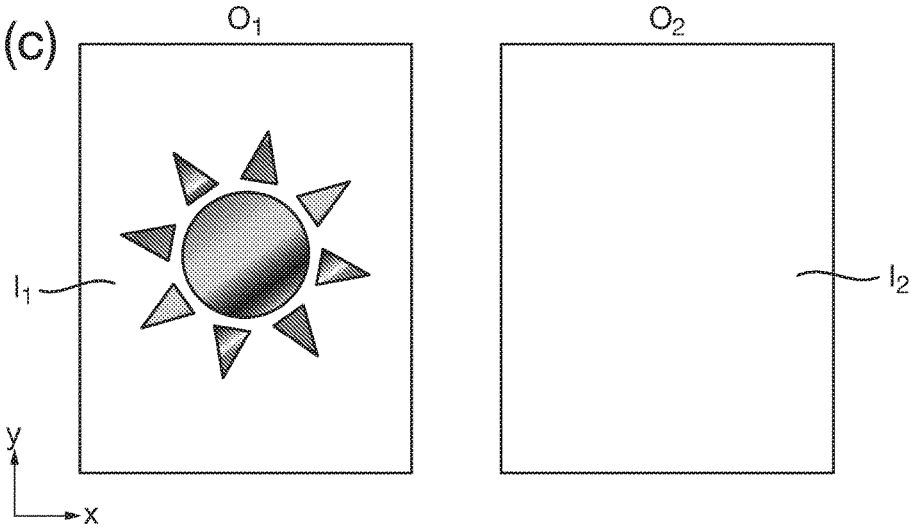

FIG. 1 depicts a first embodiment of a security device 1, which here is a lenticular device. A transparent substrate 2 (which more generally may be at least semi-transparent) is provided on one surface with an array of focussing elements 5, here in the form of cylindrical lenses, and on the other surface with an image array 10. The image array comprises first image elements 12, each of which carries a (different) portion of a corresponding first image $I_1$, whilst the size and shape of each first image element 12 is substantially identical in this example. The first image elements 12 are spaced by regions 14 in which no image element is present in this example, i.e. gaps. The image elements 12 in this example are elongate image strips and so the overall pattern of elements is a line pattern, the elongate direction of the lines lying substantially parallel to the axial direction of the focussing elements 5, which here is along the y-axis. The lateral extent of the pattern (including its elements 12 and regions 14) is referred to as the array area. In this case the arrangement of image element 12 is uniform across the whole array area and therefore forms a single region. In other examples, as discussed below, the array area may be divided into two or more regions, the image elements being arranged differently in each region, to achieve more complex effects.

As shown best in the cross-section of FIG. 1(*b*), the image array 10 and focussing element array have substantially the same periodicity as one another in the x-axis direction, such that one first image element 12 and one region 14 lies under each lens 5. The width w of all the image elements 12 is substantially the same. In this case, as is preferred, the width w of each element 12 is approximately half that of the lens pitch p, as is the space s between each adjacent pair of elements 12 (corresponding to the width of the regions 14). Thus approximately 50% of the array area carries first image elements 12 and the other 50% corresponds to regions 14. In this example, the image array 10 is registered to the lens array 5 in the x-axis direction (i.e. in the arrays' direction of periodicity) such that a first image element 12 lies under the left half of each lens and a region 14 lies under the right half. However, registration between the lens array 5 and the image array 10 in the periodic dimension is not essential.

When the device 1 is viewed by a first observer $O_1$ from a first viewing angle, each lens 5 will direct light from its underlying first image element 12 to the observer, with the result that the device as a whole exhibits the complete first image $I_1$ across the array area, as illustrated in the left diagram of FIG. 1(*c*). In this example, the first image is a multi-coloured sun-shaped symbol on a white background. When the device is tilted so that it is viewed by second observer $O_2$ from a second viewing angle, now each lens 5 directs light from its underlying blank region 14 to the observer. As such the whole array area now appears blank, as shown in the right diagram of FIG. 1(*c*), which effectively constitutes a second image $I_2$. Hence, as the security device 1 is tilted back and forth between the positions of observer $O_1$ and observer $O_2$, the appearance of the device switches between first image $I_1$ and second image $I_2$, which in this case gives the effect of first image $I_1$ "flashing" on and off.

In order to achieve an acceptably low thickness (t) of the security device 1 (e.g. around 70 microns or less where the device is to be formed on a transparent document substrate, such as a polymer banknote, or around 40 microns or less where the device is to be formed on a thread, foil or patch), the pitch p of the lenses must also be around the same order of magnitude (e.g. 70 microns or 40 microns). Therefore the width w of the first image elements is preferably no more than half such dimensions, e.g. 35 microns or less.

Figure 2A:
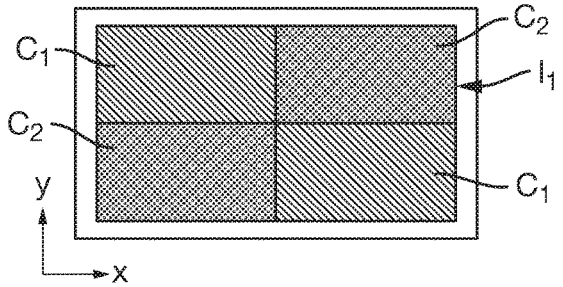
Fig. 2(a) (Prior Art)
FIG. 2 depicts a conventional method of manufacturing an image element array, for comparison, FIG. 2(*a*) showing an exemplary first image, FIG. 2(*b*) showing the desired image element array and FIG. 2(*c*) illustrating exemplary apparatus used to manufacture the image element array and the resulting product.
Figure 2B:
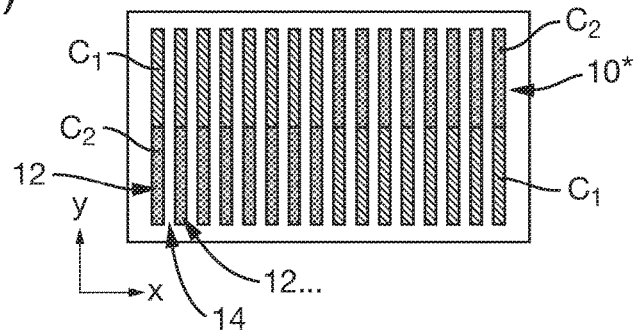
Figure 2C:
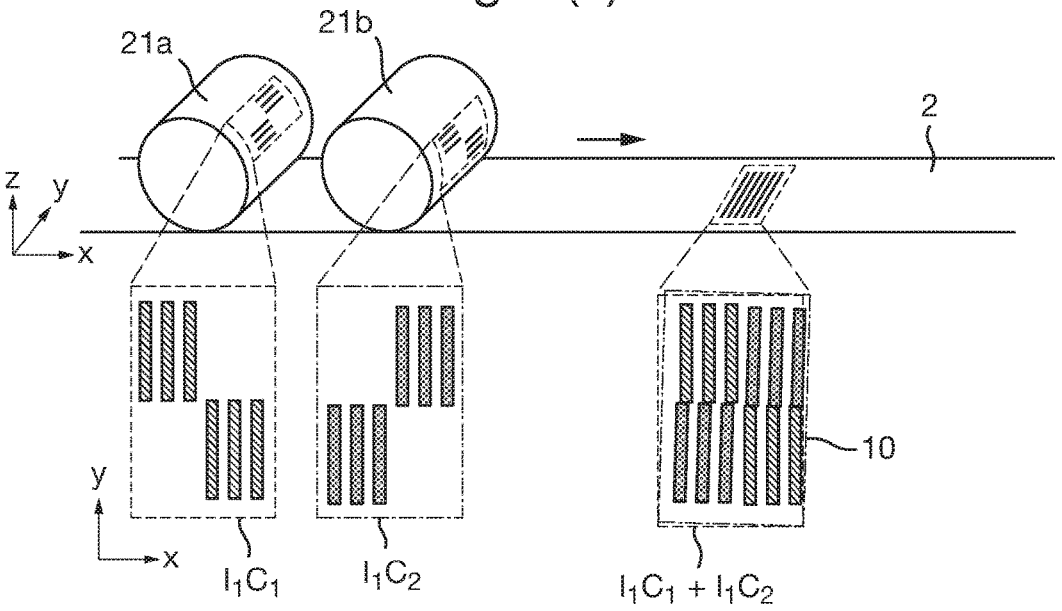

For comparison, FIG. 2 shows a known method by which the manufacture of multi-coloured image element arrays of the sort required in the FIG. 1 device has previously been attempted. FIG. 2(*a*) shows an exemplary first image $I_1$, which here is a simple block pattern of two colours $C_1$ and $C_2$. This is the image which it is desired that the device will display over one range of viewing angles. The necessary image element array 10* required to achieve this effect is shown in FIG. 2(*b*). As shown, elongate elements 12 of the first image $I_1$ are spaced by gaps 14 along the x-axis direction. One portion of each image element 12 needs to be of the first colour $C_1$ and another portion of the second colour $C_2$ in order to reproduce the desired first image $I_1$.

Figure 10:
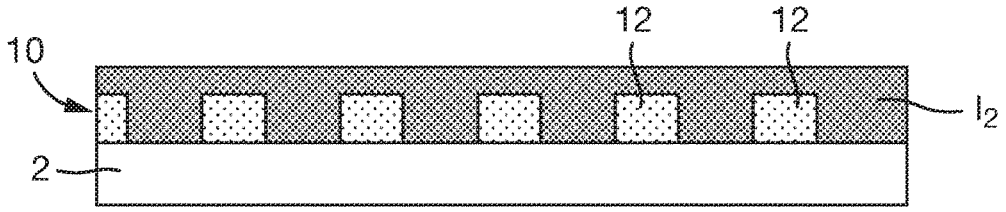

FIG. 2(*c*) shows exemplary apparatus used to manufacture the image array conventionally. Two patterned print rollers 21*a*, 21*b* are provided, one to apply each of the two different coloured inks required. Roller 21*a* is patterned to apply the portions of the image elements 12 having the first colour $C_1$ (an enlarged portion of which is shown as $I_1C_1$ in FIG. 2(*c*)), whilst roller 21*b* is patterned to apply the remaining portions of image element 12 in the second colour $C_2$ (an enlarged portion of which is shown as $I_1C_2$), in sequence to a substrate 2. However, since as described above the individual image elements 12 have a width of typically 50 microns or less, the resulting array 10 formed on the substrate 2 is not an accurate reproduction of the desired image element array 10* shown in FIG. 2(*b*). Rather, since it is not possible to register the two print rollers 21*a*, 21*b* to one another with sufficient accuracy, as shown in FIG. 10(*c*), the different coloured portions will not abut one another correctly, exhibiting translational and/or rotational (skew) misalignment (labelled as "$I_1C_1+I_1C_2$"). When the resulting image element array 10 is combined with a viewing element array 5, the desired optical effects will not be achieved or only with poor quality.

Figure 3:
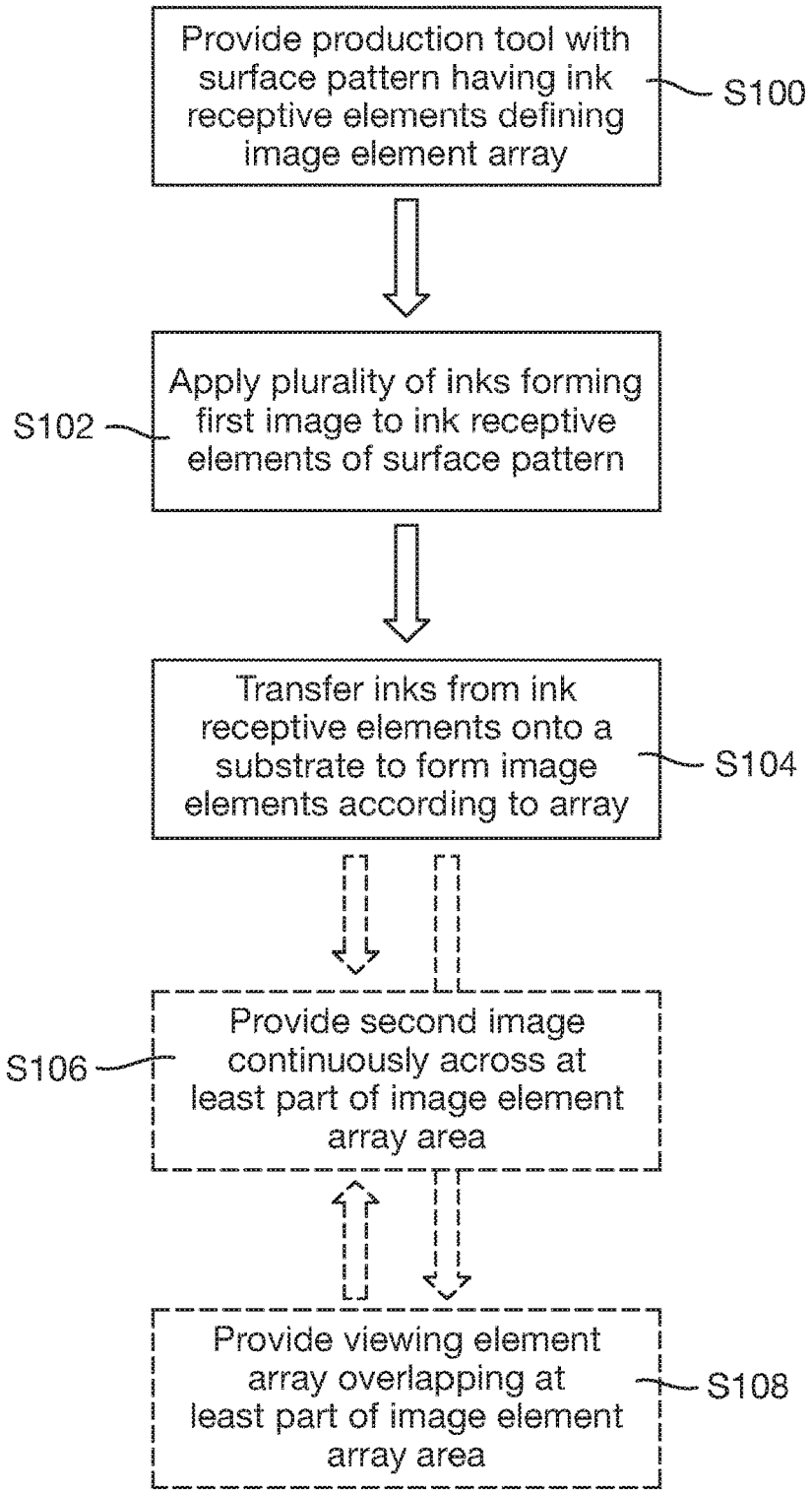
FIG. 3 is a flow diagram showing steps of a first embodiment of a method of manufacturing an image array in accordance with the present invention and optional incorporation thereof into a security device.

FIG. 3 is a flow diagram presenting steps of a method for manufacturing image element arrays of the sort described above in accordance with an embodiment of the invention. Steps shown in dashed lines are optional. In step S100, a production tool, such as a print cylinder, is provided with a surface pattern which defines the arrangement of image elements in the desired image element array—that is, their size, shape and position (but not their colours). The surface pattern can be formed in various different ways but essentially is made up of ink-receptive elements and intervening areas which are not receptive to ink. As described further below, the surface pattern could for instance take the form of a surface relief in which case the elevations will provide the ink-receptive elements. Alternatively the surface pattern could comprise areas of the production tool surface with different surface energies so that the ink does and does not adhere to different respective areas of the tool, e.g. hydrophilic and hydrophobic areas. The surface pattern will be formed with the ink receptive elements having the small dimensions desired to obtain the effects desired above, e.g. line widths of 100 microns or less, preferably 50 microns or less, more preferably 30 microns or less. Techniques for forming such patterns at these high resolutions are known. For example, high resolution masks for contact copying into lithographic plates are supplied by many companies, including JD Photo-Tools of Oldham, United Kingdom.

In step S102, a first image $I_1$ formed of a plurality of inks such that it is multicoloured is applied to the ink receptive elements of the surface pattern (only). That is, the inks are only transferred onto the ink receptive elements and not onto the intervening areas of the pattern. The ink now carried by the production tool will be in multiple colours arranged in accordance with the first image but will only be present on the ink receptive elements, i.e. those portions of the first image $I_1$ falling into the non-ink-receptive areas of the pattern will be lost. The ink on the production tool is thereby in the form of image elements sized, shaped and arranged as required by the image element array layout according to which the surface pattern was formed.

In step S104, the inks carried on the production tool are transferred onto a substrate to thereby form the image element array. This transfer may be direct or indirect, depending primarily on the nature of the production tool. That is, the production tool itself may be brought into contact with the substrate or with another transfer assembly, such as a transfer blanket, which is then contacted with the substrate.

In the resulting image element array, the image elements will be sized and shaped precisely in accordance with the desired arrangement since this depends solely on the surface pattern provided on the production tool. The image elements will be formed in multiple colours (either individually or across the array as a whole) but the portions of different colours will abut one another seamlessly since all of the inks are transferred onto the substrate simultaneously with one another.

All further processing steps are optional. In many cases, it is adequate for the security device to carry a single image (the first image $I_1$) since even complex visual effects can be achieved in this way as discussed below. Where this is the case, the spaces between image elements in the array will be blank such that, at viewing angles at which the first image is not displayed, that region of the device will be blank. However in other embodiments it may be desirable to equip the device with a second image ($I_2$) and so optional step S106 involves providing such a second image continuously across at least part of the image element array area. There is no need to apply the second image in the form of separate image elements, since the existing image element array acts as a mask concealing those parts of the second image overlapped by image elements. Thus, no registration between the image element array and the second image is needed. In practice, the second image could be provided before or after the image element array is applied to the substrate as will be discussed further below. The second image could be a uniform background colour or could be any form of more complex graphic.

To form a security element comprising the so-produced image element array (with or without a second image), in step S108 a viewing element array is arranged to overlap at least part of the image element array. As mentioned above the viewing element array may comprise focussing elements such as lenses or mirrors (to form a lenticular device) or could comprise alternative light control elements such as apertures in a masking grid. The viewing element array will be configured to cooperate with the image element array to achieve the above-described optically variable effect, e.g. by appropriate selection of its periodicity and orientation. Preferably the periodicity of the viewing element array should be equal to that of the image element array (or a multiple thereof) in at least one direction. The viewing element array should be registered to the image element array at least in terms of orientation and optionally in terms of translational position. The viewing element array can be formed either before or after the image element array is applied to the substrate.

FIG. 4 illustrates an embodiment the above described method with reference to exemplary artwork and manufacturing apparatus. FIGS. 4(*a*) and (*b*) show a first image $I_1$ and the desired image element array 10*, respectively, and it will be seen that these are the same as those of FIGS. 2(*a*) and (*b*), for ease of comparison. FIG. 4(*c*) depicts exemplary manufacturing apparatus for implementing the presently-disclosed method. Here, the production tool 25 takes the form of a patterned cylinder such as a flexographic print cylinder or a lithographic print cylinder. A surface pattern P of ink-receptive elements (represented by the dark lines) and non-ink-receptive areas is provided about at least part of its circumference. In this example, the ink-receptive elements have the form of straight, parallel lines since this is the desired form of the image elements 12. The multicoloured first image $I_1$ is applied onto the ink-receptive elements of the surface pattern P on the production tool 25, in this case using two patterned ink application surfaces (e.g. rollers) 21*a*, 21*b* (the means for supplying ink to each application surface is omitted from FIG. 4(*c*) for clarity).

In alternative embodiments an intermediate collection tool may be provided between the patterned ink application surfaces 21*a*, 21*b* and the production tool 25 as described further below.

Each of the ink application surfaces 21*a*, 21*b* carries a pattern in accordance with one colour component of the first image $I_1$. Thus in this example roller 21*a* carries the first colour component $I_1C_1$ of the first image, comprising blocks of the first colour $C_1$ at the same macro scale in which they are present in the first image. Likewise, roller 21*b* carries the second colour component $I_1C_2$ of the first image, comprising blocks of the second colour $C_2$. It should be noted that the patterns provided on the rollers 21*a*, 21*b* are not influenced by the desired image element array 10* in any way. The rollers 21*a*, 21*b* are registered to one another sufficiently to achieve macro-registration between the first and second colours $C_1$, $C_2$ once applied to the production tool 25, e.g. to about 100 microns. However, micro-level registration between the colours $C_1$, $C_2$ is not required since misregister on this level will be substantially indiscernible to the naked eye.

In this way, the two inks (of respective colour $C_1$, $C_2$) are applied to the ink-receptive elements of the surface pattern P only. Any portions of the inks provided in accordance with the respective image components but falling outside the ink-receptive elements of the pattern P will not adhere onto the production tool but rather may remain on the rollers 21*a*, 21*b* or may run off the surface of the production tool, depending on its construction. Techniques for achieving this selective application of ink are known from flexographic printing and lithographic/offset printing methods, for example.

The inks carried on the ink-receptive elements of the surface pattern are then transferred onto a substrate 2 which in this example is brought into direct contact with the production tool 25 (although this is not essential as discussed below). The transferred inks thereby take the form of image elements 12 arranged precisely in accordance with the desired image element array 10. In effect, the resulting arrangement of inks on the substrate 2 is the sum of the different colour image components ($I_1C_1$+$I_1C_2$), convolved with the surface pattern P.

The inks used could be conventional printing inks such as lithographic or flexographic inks, in which case they may dry naturally or may be dried using a heater 50. Alternatively, the inks could be curable inks, such as radiation curable inks, in which case a curing unit 51' may be provided to cure the image element array 10 once it has been applied to the substrate 2. The relatively fast speed of curing relative to standard drying assists in reducing ink spread and smudging. Generally, the term "ink" is used herein to denote a composition comprising one or more substances having an optically detectable characteristic dispersed in a binder (which may or may not be driven off upon drying/curing). The optically detectable substances could be pigments, dyes, reflective particles, metallic flakes, pearlescent particles, interference layer structures, etc. The optically detectable characteristics may or may not be visible to the human eye and/or could require certain illumination to make them visible. For example, one or more of the inks could be phosphorescent, fluorescent or luminescence.

The term "multicoloured" is intended to cover any image comprising two or more inks (which have different spatial distribution from one another) with different optically variable characteristics, whether or not that is apparent to the naked eye. Further, the term "colour" is taken to include achromatic tones such as black, grey, white, silver etc. as well as hues such as red, green, blue etc. In preferred cases the first image will comprise at least three different inks, preferably of different visible colours. For example, the first image may desirably be a RGB, RGBK or CMYK image. Of course, another patterned ink application surface 21*a*, 21*b* etc will be needed for each colour provided.

Figure 5A:
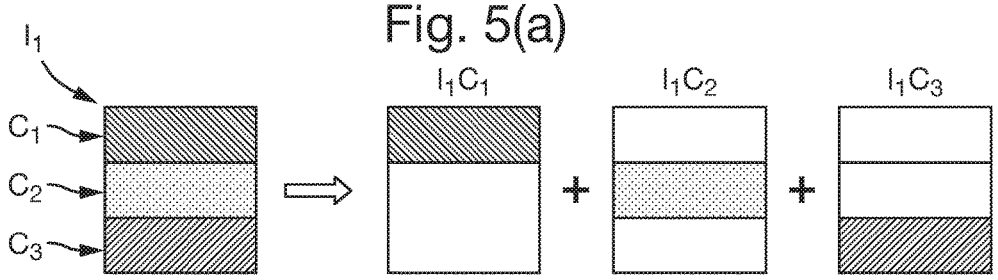
FIG. 5 is a schematic diagram illustrating differences between conventional methods and examples of methods in accordance with embodiments of the present invention.
Figure 5B:
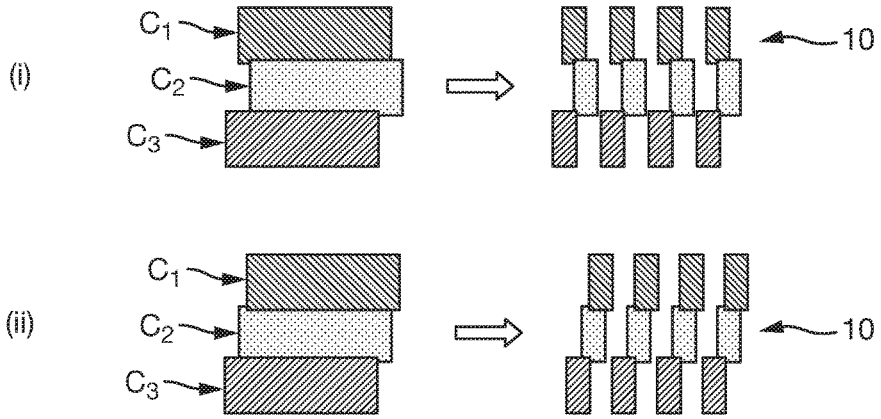
Fig. 5(b) (Prior Art)
Figure 5C:
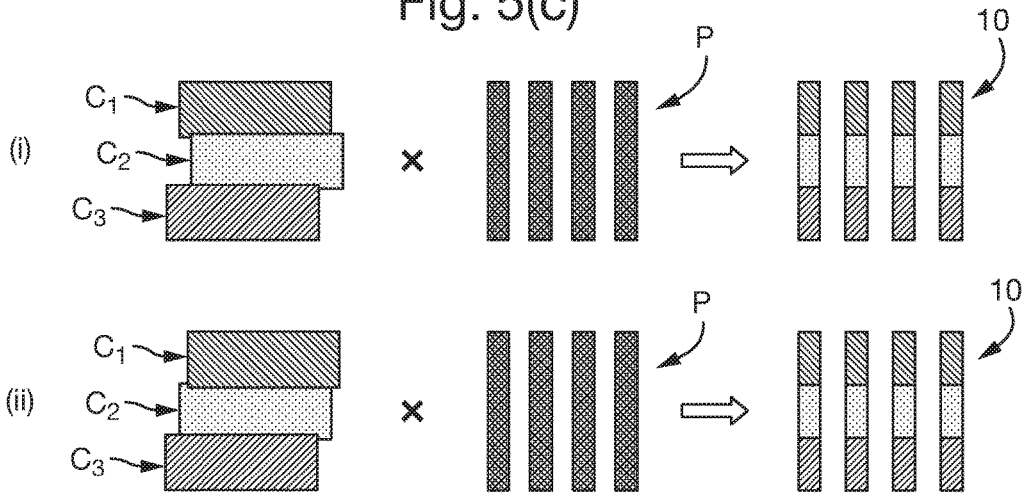

To further demonstrate the benefits achieved by the presently disclosed method, FIG. 5 directly contrasts exemplary image arrays 10 formed using conventional methods and via the presently disclosed methods, in each case intended to display the same first image, $I_1$. The desired first image $I_1$ is shown in FIG. 5(*a*), complete and also separated into its multiple colour components. In this example, the image $I_1$ is a rectangle formed of three colour blocks, each having a different colour $C_1$, $C_2$, and $C_3$. Conventional software can be used to separate the multi-coloured image $I_1$ into its constituent colour parts, $I_1C_1$, $I_1C_2$ and $I_1C_3$, which correspond to the pattern on each respective colour plate that will be printed down to form the complete image $I_1$.

FIG. 5(*b*) illustrates results achievable using conventional techniques, such as that of FIG. 2, where each individual colour component will be divided into the necessary high resolution image elements and then these will be printed down sequentially for each colour. Since highly accurate registration (e.g. beyond about 100 microns) cannot be achieved between the three colours, this means that the various parts of the high resolution image elements will not align correctly. FIGS. 5(*b*) (i) and (ii)) show two examples of typical mis-registration that may occur between the colours during printing (and cannot be eliminated or controlled beyond a certain level). For instance, in FIG. 5(*b*)(*i*), colours $C_1$ and $C_3$ are each shifted to the left, relative to colour $C_2$, by differing amounts, with the result that the corresponding portions of the image elements 10 ultimately applied to the substrate will also be so shifted. Since the different parts of each image element will no longer correctly align under each viewing element (e.g. lens), the resulting optically variable effect will be poor (or non-existent).

Similarly, FIG. 5(*b*) (i) and (ii) shows another example of mis-registration which may occur in another instance when the first image $I_1$ is printed, this time with colours $C_1$ and $C_2$ shifted to the right relative to colour $C_3$. Again, the mis-registration is directly apparent in the so-formed image elements 10 which will not operate correctly.

In contrast, FIG. 5(*c*) illustrates results achievable using the presently disclosed methods, such as that of FIG. 4, in which the individual colour components are not themselves divided into image elements. Rather, as described previously, the complete first image $I_1$ is applied to a surface pattern P, e.g. by printing each of the colour components $I_1$, $I_1C_2$, and $I_1C_3$ onto that surface pattern in their entirety. The surface pattern P effectively selects which parts of each colour component are transferred onto the substrate to form the image elements 10, and hence their final shape and arrangement is independent of any mis-registration occurring between the colour components. For instance, Figures (c)(i) and (ii) show the same exemplary mis-registrations as those encountered in Figures (b)(i) and (ii) respectively. Now, however, since the retained portions of each colour are determined by the pattern P, the resulting image elements 10 are formed to the desired shape, size and arrangement and hence will generate a high quality, multi-coloured, optically variable effect in combination with an appropriate viewing element array. Thus, the various colour components of the image $I_1$ can be printed with only coarse registration ("macro-registration"), as necessary for viewing by the human eye (e.g. to no more than 100 microns), without affecting the crucially high resolution ("micro-registration") needed of the image elements 10 themselves.

An exemplary image element array 10 applied to a substrate 2 using the presently disclosed method (e.g. that of FIG. 4) is shown in cross-section in FIG. 6. It will be appreciated that the image elements 12 will be formed of at least two inks although this is not depicted in the Figure. This may be in terms of individual ones of the elements (i.e. any one of the elements 12 may itself comprise portions of different inks) and/or in terms of the array as a whole (i.e. certain ones of the elements 12 may be formed entirely of one ink, and others entirely of another ink). The image elements 12 are spaced by gaps 14 corresponding to the non-ink-receptive areas of the surface pattern P on the production tool 25.

FIG. 7*a* shows an exemplary security device 1 into which the image element array 10 can be incorporated. In this case the security device 1 is a lenticular device, comprising an array of focussing elements 5, such as lenses or mirrors. The depicted construction can be arrived at by forming the focussing elements 5 in a transparent material 3 applied over the image element array 10 after it has been formed on the substrate 2, which may be transparent or opaque in this example. For instance, the focussing element array could be formed by cast-curing. In this case the optically variable effect can be viewed by an observer $O_1$ located on the same side of the substrate 2 as the image element array 10.

FIG. 7*b* shows an alternative construction of an exemplary security device 1 comprising the image element array 10, which again is a lenticular device. In this case the focussing element array 5 is applied to the opposite surface of the substrate 2 from that on which the image element array 10 is formed. Here, the substrate 2 will be at least semi-transparent, i.e. optically clear (but possibly with a coloured tint). The focussing element array 5 can be formed on a separate substrate 4 (also transparent) which is affixed to the substrate 2, before or after the application of the image element array 10. Alternatively the focussing element array can be formed by cast curing onto the surface of the substrate 2 opposite from that on which the image element array 10 is applied. Again this can take place either before or after the application of the image element array 10. In this configuration the optically variable effect can be viewed by an observer $O_1$ located on the opposite side of the substrate 2 from that on which the image element array 10 is located.

In all cases, the substrate 2 could take the form of a foil, suitable for forming the basis of a security article such as a security thread, strip, label or patch (in which case it will typically be thin, e.g. 30 microns or less), or the substrate 2 could be a document substrate, e.g. of polymer, paper or a hybrid thereof. In the latter case the substrate 2 will typically have a thickness around 70 to 100 microns.

As mentioned above, in many cases only one image (the first image $I_1$) will be incorporated into the device. However, in other embodiments it may be preferred to provide an additional second image $I_2$ which fills in the gaps 14 between the image elements 12 of the image element array 10. Thus, in the finished security device, the second image $I_2$ will be displayed at the viewing angles at which the first image is not, replacing the blank appearance described in previous embodiments. The second image $I_2$ can be arranged to overlap both the image elements 12 and the gaps 14 since when the assembly is viewed from the side of the image element array 10, the image elements 12 will conceal the underlying portions of the second image $I_2$. Hence the second image $I_2$ can be applied using any desirable process since high resolution is not required. Further, there is no need for registration between the image element array 10 and the second image $I_2$.

Figure 8:
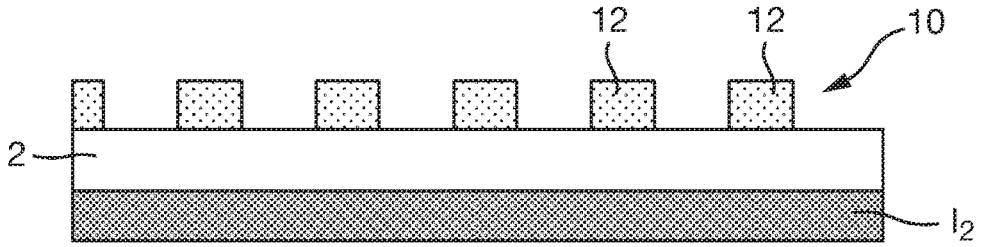

Thus, FIG. 8 show an exemplary construction in which the second image $I_2$ is applied to the opposite surface of the substrate 2 from that to which the image element array 10 is transferred in the above method. Here the substrate 2 will need to be at least semi-transparent. The second image $I_2$ can be applied to the substrate before, after or even during application of the image element array 10 thereto.

Figure 9:
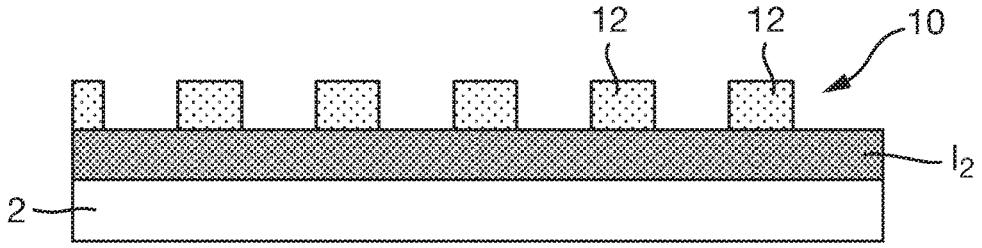

FIG. 9 shows an alternative construction in which the second image $I_2$ underlies the image element array 10 on the same surface of the substrate 2. In this case the second image $I_2$ will need to be provided on the substrate before application of the image element array 10. The reverse is true for the FIG. 10 embodiment where the second image $I_2$ is applied over the top of the image element array 10. In this case the substrate 2 will need to be at least semi-transparent.

Figure 11:
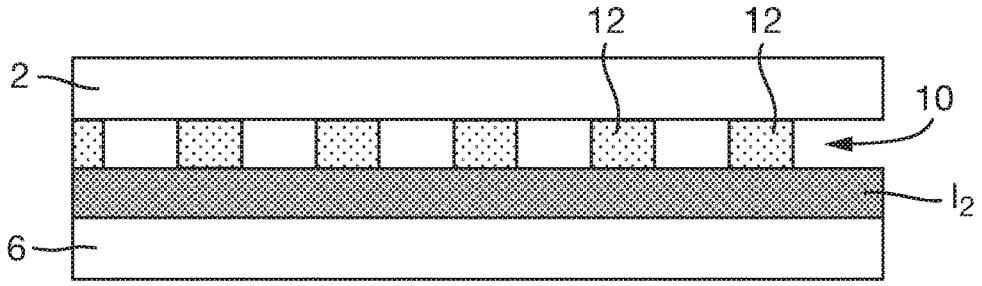

FIG. 11 shows a further alternative in which the image array 10 is applied to one substrate 2, which is at least semi-transparent, and the second image $I_2$ is formed on a second substrate 6, which could be transparent or opaque. The two substrates are then affixed to one another, e.g. by adhesive (not shown). For example the substrate 2 with the image element array 10 could take the form of a label which is stuck on to pre-printed second substrate 6, which could be a security document such as a paper banknote.

In each of the above examples, the security device can be completed by providing an appropriate viewing element array on the side of the arrangement from which both the image elements 12 and the second image $I_2$ therebetween can be viewed.

The second image could be a printed image using any available technique such as offset, lithographic, flexographic, intaglio, ink jet, thermal transfer printing etc. Alternatively, the second image could comprise a metal layer, e.g. formed by vapour deposition, which may or may not carry a demetallised pattern or image. Some particularly preferred implementations of the above-described image element array manufacturing method will now be described with reference to FIGS. 12 to 15.

Figure 12:
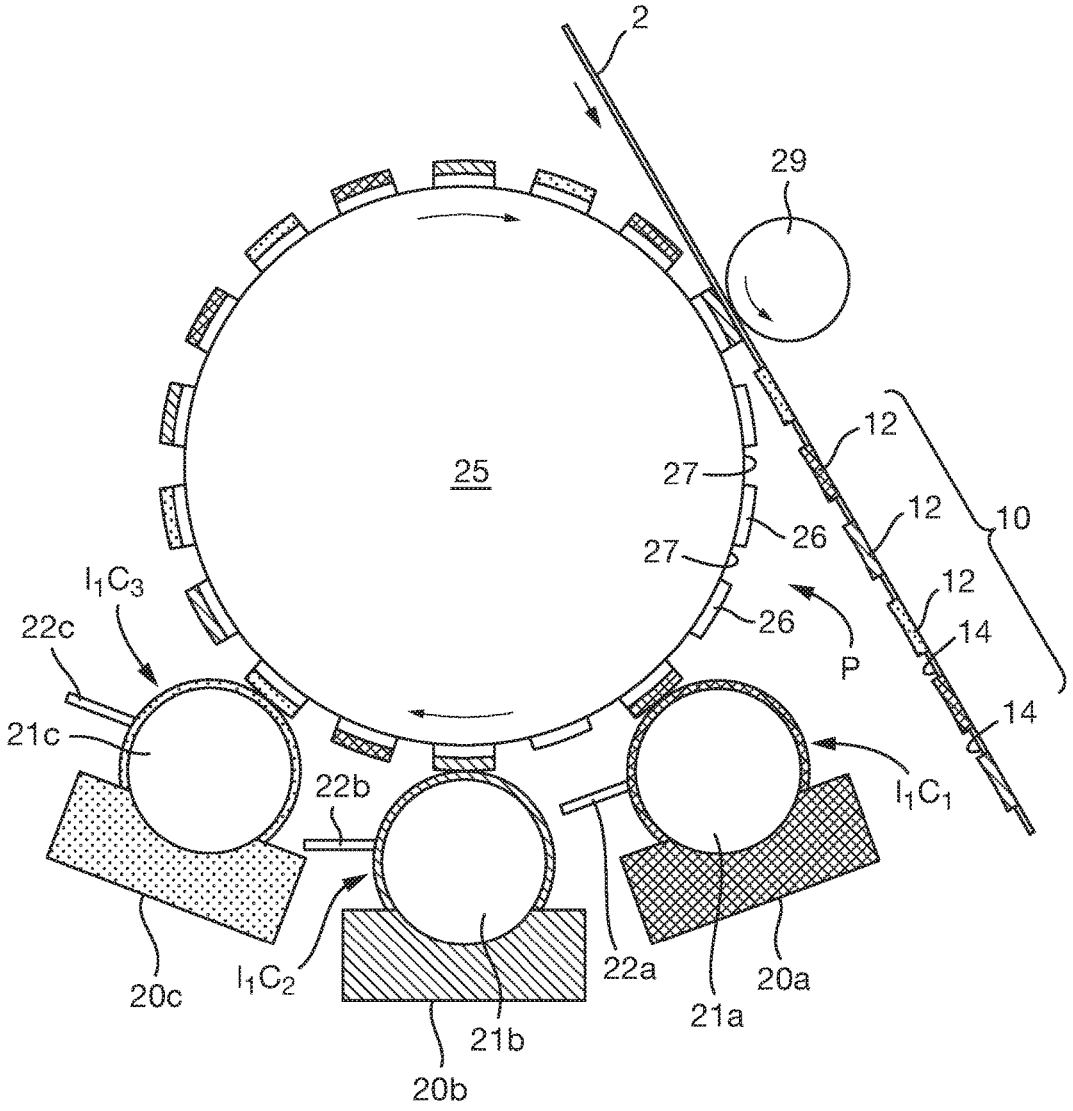
Figure 13:
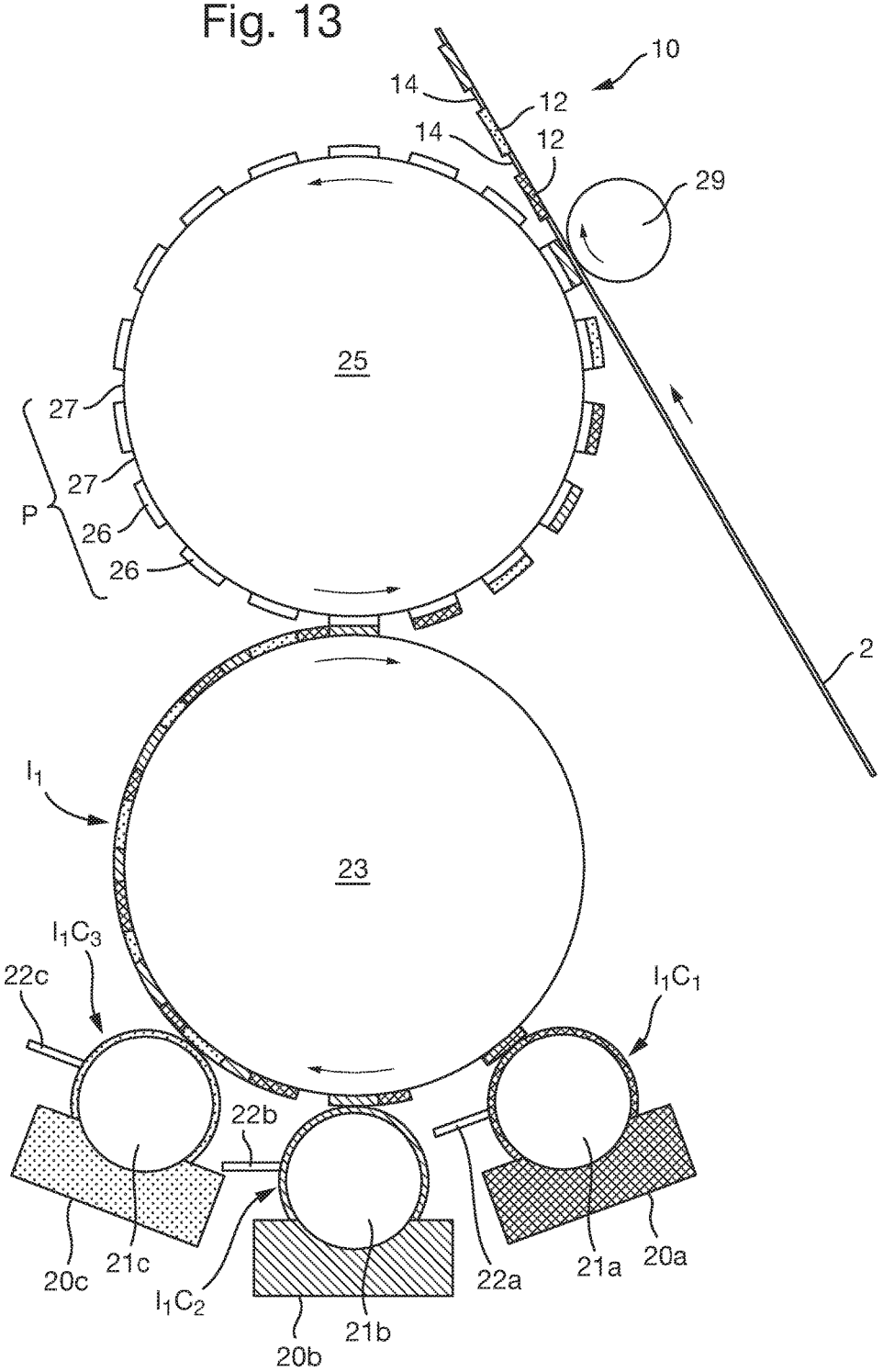

In the embodiments of FIGS. 12 and 13, the production tool 25 has a surface pattern P in the form of a surface relief structure. The elevations of the surface relief constitute the ink-receptive portions 26 of the pattern, and hence are configured to correspond to the desired image elements 12, whilst the depressions provide the non-ink-receptive areas 27 therebetween. In the example shown in FIG. 12, the first image $I_1$ is a three colour image (e.g. RGB) and hence three inks 20*a*, 20*b* and 20*c* are provided. A patterned ink application surface 21*a*, 21*b*, 21*c* is provided for each ink, each patterned in accordance with the corresponding colour component of the first image. Thus, roller 21*a* carries a pattern corresponding to the first colour component of the first image ($I_1C_1$), roller 21*b* carries component $I_1C_2$, and roller 21*c* carries component $I_1C_3$. In this example the three inks are conventional flexographic type inks and are applied to the rollers 21*a*, 21*b*, 21*c* from corresponding ink chambers. The rollers 21*a*, 21*b*, 21*c* may be patterned anilox or gravure rollers for example. Metering means such as plates 22*a*, 22*b*, 22*c* may be provided to control the applied ink weight.

The production tool 25 may be a flexographic plate having the desired surface relief structure defining pattern P, carried on a cylinder. For instance, if the desired image array comprises rectilinear image elements 12 as in the FIG. 4 example, the pattern P will comprise a series of straight, parallel elevations 26. Only the elevations 26 of the pattern come into contact with the ink on the three patterned rollers 21*a*, 21*b*, 21*c*. The inks thereby adhere to the elevations 26 of the pattern P but do not transfer into the depressions 27. The so-produced image elements 12 are then transferred from the production tool 25 onto a substrate 2 using an impression roller 29 to result in image element array 10.

FIG. 13 shows a variant in which the three colour components $I_1C_1$, $I_1C_2$ and $I_1C_3$ are applied to a transfer blanket or other collection surface 23 rather than directly to the elevations 26 on the production tool 25. The collection surface 23 therefore carries the complete first image $I_1$ before portions of it are picked off by the elevations of pattern P on the production tool 25 to form the image elements 12. All other aspects of the FIG. 13 embodiment are the same as in the FIG. 12 embodiment.

Figure 14:
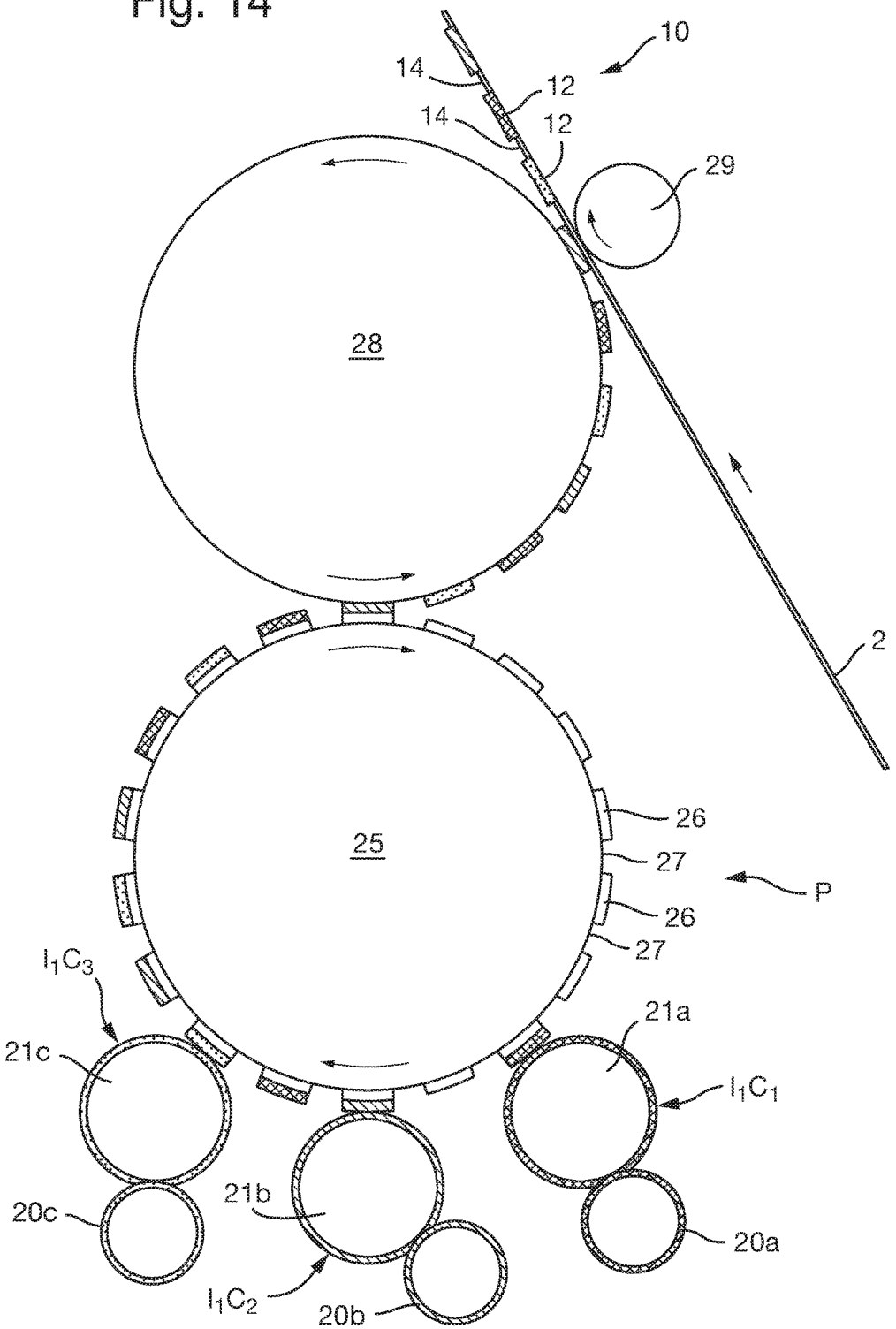
Figure 15:
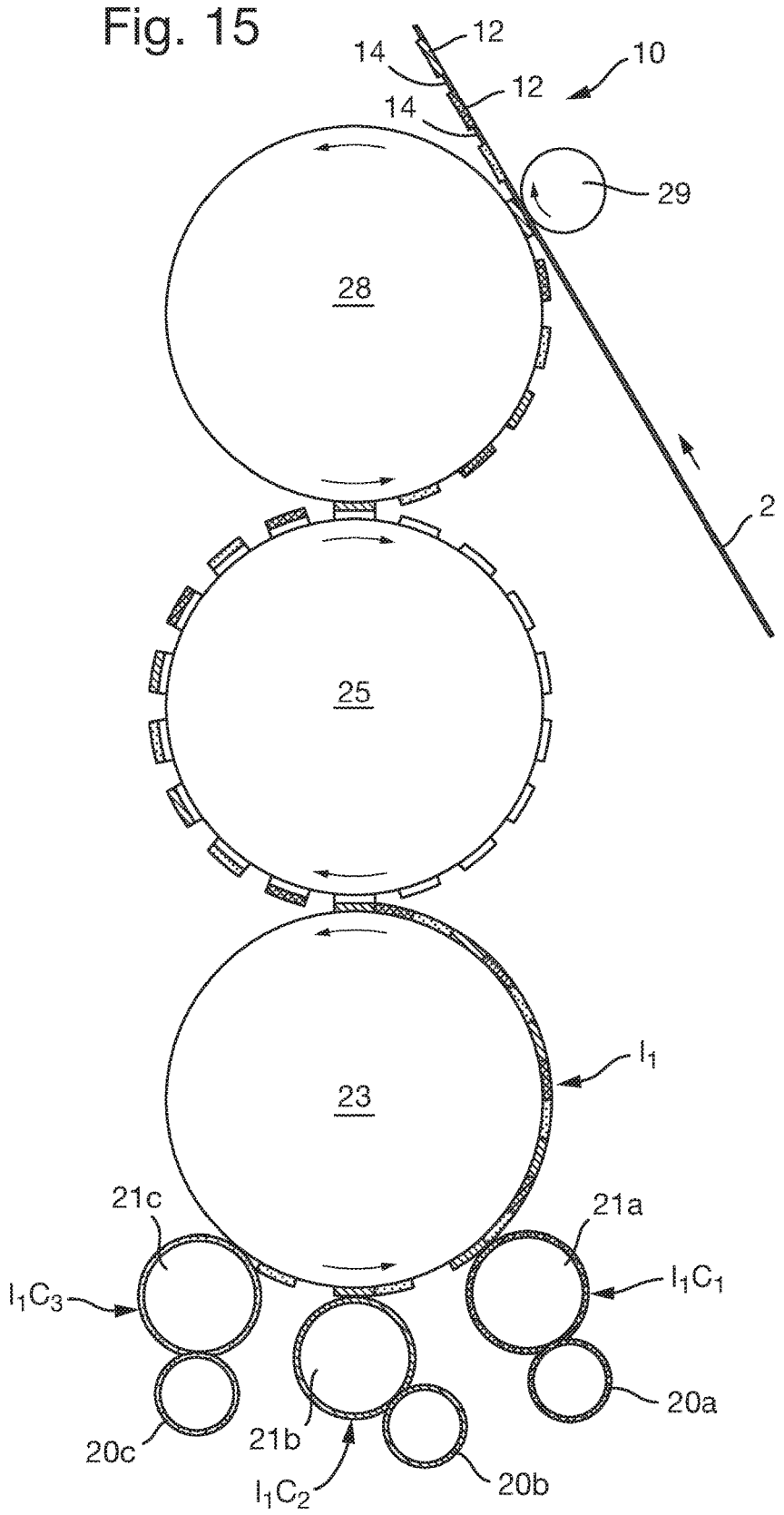
Figure 16A:
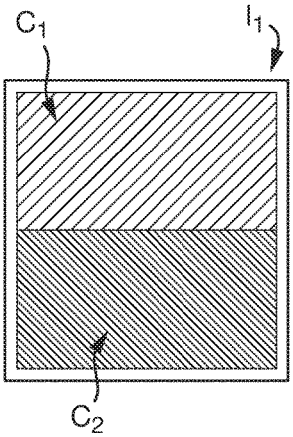
Figure 16B:
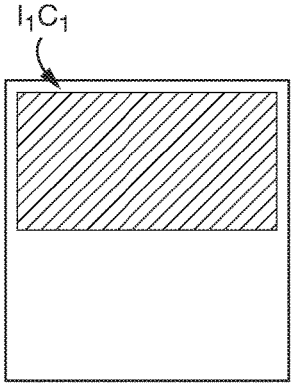
Figure 16C:
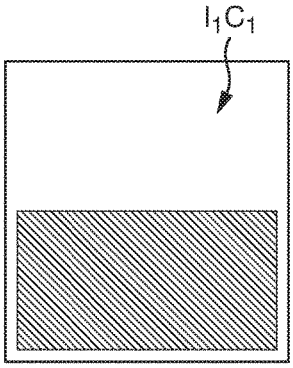
Figure 16D:
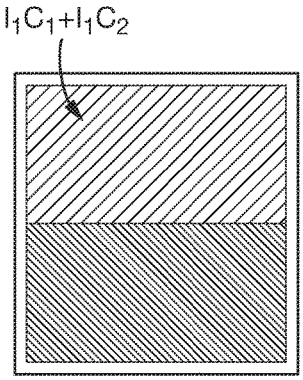
Figure 16E:
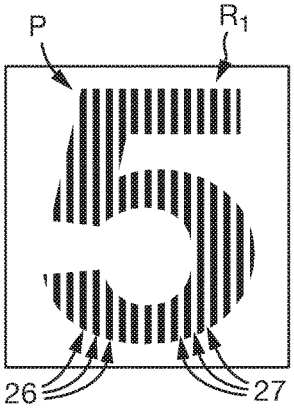
Figure 16F:
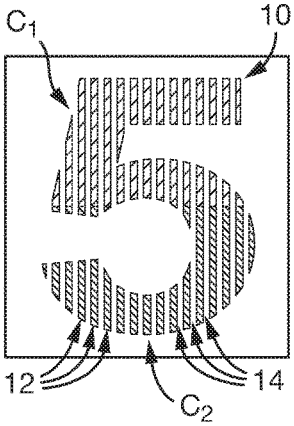
Figure 16G:
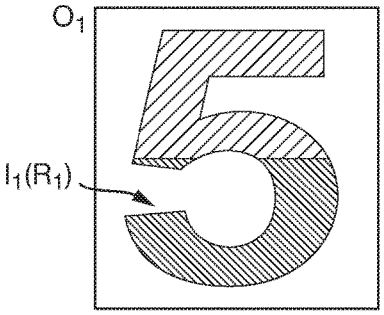
Figure 16H:
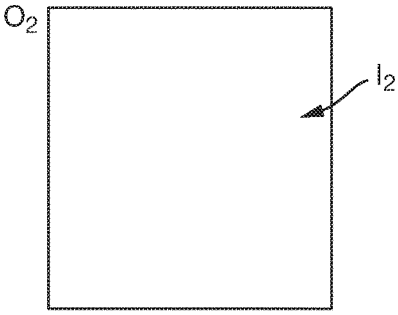
Figure 17A:
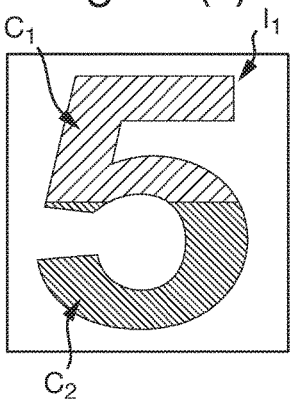
Figure 17B:
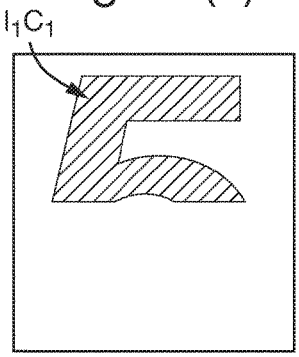
Figure 17C:
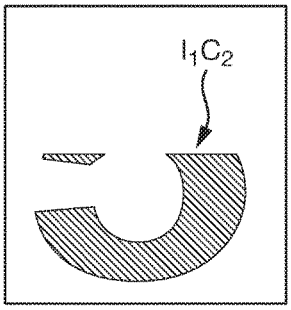
Figure 17D:
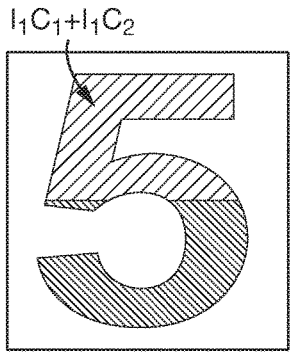
Figure 17E:
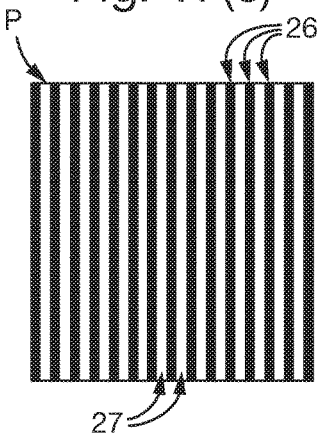
Figure 17F:
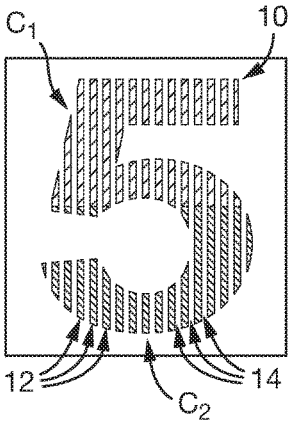
Figure 17G:
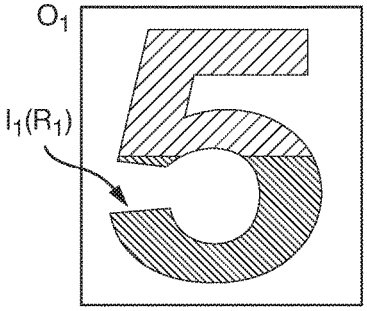
Figure 17H:
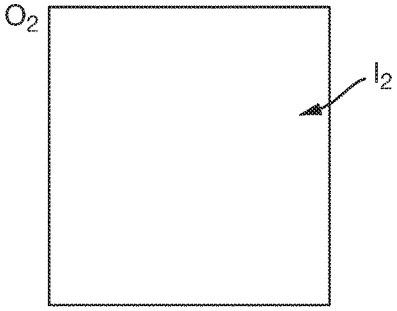
Figure 18A:
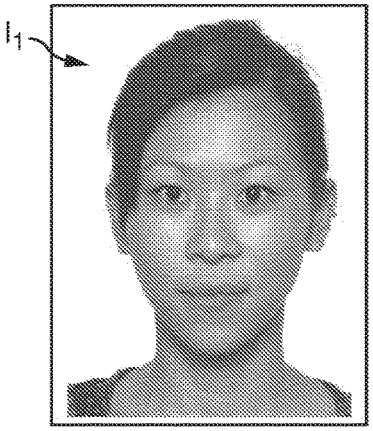
Figure 18B:
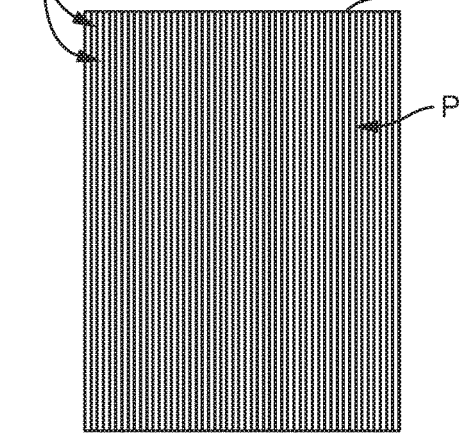
Figure 18C:
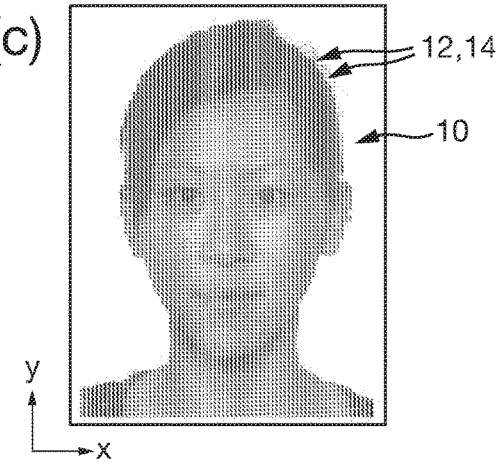
Figure 18D:
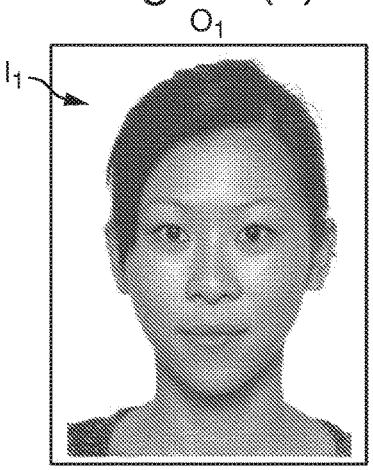
Figure 18E:
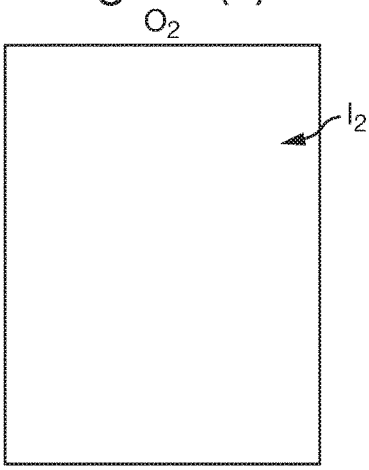

The embodiments of FIGS. 14 and 15 differ in two key respects from those of FIGS. 12 and 13. Here, the pattern P on production tool 25 is not formed as a surface relief but rather comprises areas with different surface energies from one another, e.g. as a result of chemical treatment and/or of the areas being formed of different materials from one another. (The areas 26 are depicted as being elevated in FIGS. 14 and 15 purely to illustrate their location on the surface of the production tool 25, but in practice the surface of the tool is substantially smooth). Thus the production tool 25 may be, for example a wet or dry lithographic printing plate or a wet or dry offset printing plate. For example, the ink-receptive elements 26 may be formed by hydrophobic areas of the surface pattern whilst the non-ink receptive elements 27 are hydrophilic. In this case, prior to application of the inks 20*a*, 20*b*, 20*c* to the production tool 25 it may be dampened by the application of a water-containing fluid. A film of water is formed over the hydrophilic areas 27 preventing the adhesion of ink thereto. Thus the inks are transferred onto the hydrophobic elements 26 only to thereby form the desired image elements 12.

Due to the nature of the surface pattern P, rather than transfer the image elements 12 directly onto a substrate 2 from the production tool 25, it is preferred to contact the production tool 25 against an intermediate transfer assembly 28 such as a transfer blanket. The so-produced image elements 12 are then applied to the substrate 2 using an impression roller 29. It should be noted that an indirect transfer method such as this can also be used in the FIGS. 12 and 13 embodiments if desired.

In the FIG. 14 embodiment, the patterned ink application surfaces 21*a*, 21*b*, 21*c* are preferably patterned (wet or dry) lithographic plates or chablon plates to which respective inks 20*a*, 20*b*, 20*c* are supplied by corresponding inking rollers.

FIG. 15 shows a variant in which the three colour components $I_1C_1$, $I_1C_2$ and $I_1C_3$ are applied to a transfer blanket or other collection surface 23 rather than directly to the ink receptive elements 26 on the production tool 25. The collection surface 23 therefore carries the complete first image $I_1$ before portions of it adhere to the ink-receptive elements 26 of pattern P on the production tool 25 to form the image elements 12. All other aspects of the FIG. 15 embodiment are the same as in the FIG. 14 embodiment.

In all of the above embodiments, the three inks 20*a*, 20*b*, 20*c* are applied in register with one another. However, only macro-level registration (e.g. to about 100 microns) is required, and not micro-level registration, as previously discussed.

FIGS. 16 to 25 provide examples of image element arrays that can be manufactured using the presently disclosed techniques, and the corresponding optically variable effects which are exhibited by security devices incorporating the arrays.

A first example is shown in FIG. 16. FIG. 16(*a*) shows an exemplary first image $I_1$ which it is desired to reproduce in the security device. The image is digitally pre-processed by splitting it into its constituent colour parts, shown respectively in FIGS. 16(*b*) and (*c*), corresponding to the individual plates needed to print down the image. In this example the image $I_1$ comprises two colours of ink $C_1$, $C_2$ arranged in adjacent non-overlapping rectangular blocks, hence there are two colour parts, $I_1C_1$ and $I_1C_2$. In other examples there may be three or more colour plates, e.g. RGB, CMY or CMYK. Each of the constituent colour parts is then is applied to the production tool in the manner described in any of the embodiments above (e.g. simultaneously or sequentially) to reform thereon the first image $I_1$, as illustrated in FIG. 16(*d*). It should be noted that, whilst not shown, in practice there will likely be a degree of misregister between the various colours in the reformed first image, since this need only be applied to the production tool with coarse (macro) registration. FIG. 16(*e*) shows an exemplary surface pattern P provided on the production tool 25. The pattern P comprises a series of straight line ink-receptive elements 26 (represented in black), spaced parallel to one another by non-ink receptive areas 27. All of the elements 26 have substantially the same width as one another, which is the dimension in which they are periodic. In this example the ink receptive elements 26 are provided only across a first region $R_1$ of which the periphery defines the digit "5" (although any other item of information could be represented, e.g. a shape, letter, other number, currency identifier, symbol, logo etc). The periphery of the region $R_1$ curtails the length of the image elements 26 meaning that they have different dimensions from one another in the direction perpendicular to the periodic direction. The resulting image element array 10 is shown in FIG. 16(*f*), formed by applying the image $I_1$ onto the pattern P, and comprising a series of straight-line ink elements, some of which are individually multicoloured. As previously described, all portions of the image $I_1$ falling outside the ink receptive elements 26 of the pattern P will be lost and hence appear as gaps 14 in the image element array 10.

FIGS. 16 (*g*) and (*h*) show the appearance of a security device comprising the image element array of FIG. 16(*f*) combined with an appropriate viewing element array as described above. At a first range of viewing angles, the device will exhibit the appearance shown in FIG. 16(*g*), which is a digit "5" having its interior area filled in by a portion of the first image $I_1$. This is because in the region $R_1$, the viewing elements are directing light from the image elements 12 to the viewer. Thus the top part of the digit "5" has the first colour $C_1$ (since a portion of the upper block of image $I_1$ is being displayed here), and the lower part of the digit "5" has the second colour $C_2$. The lateral extent of the portion of the first image which is displayed is determined by the periphery of the first region $R_1$ of the image element array, hence the appearance of the digit "5". At a second range of viewing angles, shown in FIG. 16(*h*), the viewing elements no longer direct light from the image elements 12 to the viewer but instead display the gaps 14. Hence, in this example, the device appears blank. In other examples, if a second image $I_2$ were provided using one of the techniques mentioned above, this second image $I_2$ would be displayed by the device surrounding the digit "5" at the first set of viewing angles (FIG. 16(*g*)), and across the whole device at the second set of viewing angles (FIG. 16(*h*)) such that once again the digit "5" would disappear. Either way, as the device is tiled about the y-axis, the first image will be displayed in the shape of a "5" at some angles and then appear to switch off (i.e. be hidden) at others.

FIG. 17 shows a variant of the FIG. 16 example in which the appearance of the finished security device is exactly the same, but it is arrived at via an alternative route. In this example, both the shape and colour of the digit "5" which it is desired to display in the finished device are defined by the original first image $I_1$ shown in FIG. 17(*a*), which here is the digit "5" formed with its upper half in a first colour $C_1$ and its lower half in a second colour $C_2$. As before, the image $I_1$ is digitally pre-processed to split it into its component colour parts $I_1C_1$ and $I_1C_2$, shown in FIGS. 17(*b*) and (*c*) respectively. In this case, rather than comprising simple rectangular blocks, each also defines the shape of the relevant part of the digit "5". The two colour plates are then applied (simultaneously or sequentially) to reform the first image $I_1$ (FIG. 17(*d*)) with coarse registration on the surface pattern P of a production tool. FIG. 17(*e*) shows an example of a suitable surface pattern P in this case, which comprises a regular array of rectilinear ink-receptive portions 26 spaced by non-ink-receptive portions 27. The surface pattern P here differs from that in FIG. 16 since it does not define any particular periphery but rather extends all the way to the edges of the useable area of the tool.

The resulting image element array 10 is shown in FIG. 17(*f*), and it will be seen that this is identical to that of FIG. 16(*f*) above. This is because the array 10 has been formed by using the pattern P to select portions of the image $I_1$ which in this case already defines the digit "5" via its periphery. As before, all portions of the image $I_1$ falling outside the ink receptive elements 26 of the pattern P will be lost and hence appear as gaps 14 in the image element array 10. The result is a regular set of straight-line image elements 12, some of which are multi-coloured, curtailed to define a periphery having the shape of the digit "5". When the image element array 10 is combined with an appropriate viewing element array, the appearance of the device will be the same as that described with respect to FIG. 16, shown again in FIGS. 17(*g*) and (*h*).

FIG. 18 shows a second example. Again, FIG. 18(*a*) shows the first image $I_1$ and FIG. 18(*b*) shows the surface pattern P on the production tool 25. As in the previous examples, the image will be pre-processed by digitally splitting it into its component colour plates, e.g. RGB, CMY or CMYK, although these are not shown in the Figure. In this case the image $I_1$ is a multicoloured photographic image, here a passport photograph. To achieve a life-like representation the various colours of ink are arranged in a complex pixel configuration. The image may be screened or half-toned. The surface pattern P again comprises a single region $R_1$ which here covers the whole of the first image $I_1$. The ink-receptive elements 26 (again shown in black) are straight parallel lines spaced by non-ink-receptive elements 27. The resulting image element array 10 is shown in FIG. 18(*c*) and comprises an array of straight parallel "slices" of the image $I_1$ corresponding to the locations of the elements 26 in the pattern P.

FIGS. 18 (*d*) and (*e*) show the appearance of a security device comprising the image element array of FIG. 18(*c*) combined with an appropriate viewing element array as described above. At a first range of viewing angles, the device will exhibit the first image $I_1$ across its whole area, as shown in FIG. 1(*d*). At a second range of viewing angles, the first image $I_1$ will be hidden across the whole area of the device and the device will either appear blank or to display a second image $I_2$ if provided (FIG. 18(*e*)).

To illustrate further this latter point, FIG. 19 shows an exemplary security device equipped with such a second image $I_2$. FIG. 19(*a*) shows the security device in cross-section and it will be seen that the construction is as described with respect to FIG. 7*b* above, but shown the other way up and with a second image $I_2$ applied under the image array 10. In practice, the second image $I_2$ could be formed by applying it over the finished image array 10, e.g. by printing, as described above with reference to FIG. 10, for example. Alternatively the second image $I_2$ could be provided on another substrate (not shown) which is then adhered over the image array 10. In the example shown, the second image $I_2$ is a block pattern of two colours arranged to form a tiled arrangement of triangles and rectangles. It should be noted that there is no need for any registration between the second image (or its constituent parts) and the image array 10. Provided the image elements 12 are of sufficiently high optical density so as to block viewing of the underlying second image $I_2$ through them, when the security device is viewed from a first set of viewing angles, the viewing element array 5 will direct light to the viewer from the image elements 12, thereby displaying the first image $I_1$, across the device, as shown in FIG. 19(*b*). When the same device is viewed from another set of viewing angles (FIG. 19(*c*)), the viewing element array 5 will direct light to the viewer from the gaps 14 between the image elements 12, in which portions of the second image $I_2$ are visible, such that the second image $I_2$ is displayed across the device.

FIGS. 20 and 21 show a third example. FIG. 20(*a*) shows the first image which here comprises three colours $C_1$, $C_2$, $C_3$ arranged in a series of concentric circles. FIG. 20(*b*) shows the surface pattern P provided on the production tool. In this case the array is divided into two regions: a first region $R_1$ falling inside a periphery defining the digit "5", and a second region $R_2$ falling outside that periphery and surrounding the digit "5". In both regions $R_1$, $R_2$, a series of straight, parallel ink-receptive elements 26 is provided (shown in black), separated by non-ink-receptive areas 27 (white). The width and periodicity of the elements 26 is the same in both regions. However, the two sets of elements are spatially offset from one another in the direction of periodicity (here the x-axis) by an amount corresponding to the width of one element 26 (which here matches the spacing between them). The resulting image element array 10 is shown in FIG. 20(*c*) and comprises the portions of first image $I_1$ which correspond to ink-receptive elements 26 in each region of the array, forming multicoloured image elements 12 spaced by gaps 14.

FIG. 21 shows the appearance of a security device comprising the image element array of FIG. 20(*c*) combined with an appropriate viewing element array as described above. At a first range of viewing angles, the device will exhibit the appearance shown in FIG. 21(*a*), which is a digit "5" having its interior area filled in by a portion of the first image $I_1$. This is because in the region $R_1$, the viewing elements are directing light from the image elements 12 to the viewer whereas in the region $R_2$, the viewing elements are directing light from the gaps 14 to the viewer, such that the area surrounding the digit "5" appears blank. At the second set of viewing angles (FIG. 21(*b*)), the appearance of the device is reversed: in the first region $R_1$, the first image $I_1$ is now hidden and the region appears blank, whilst in the surrounding second region $R_2$, the first image is now displayed. As before, if a second image $I_2$ is provided then that second image $I_2$ will be displayed in the second region $R_2$ at the first set of viewing angles and in the first region $R_1$ at the second set of viewing angles (i.e. replacing the blank areas shown in FIG. 21).

FIGS. 22 and 23 show a fourth example. Here, the first image $I_1$ is the same as in the previous example (FIG. 22(*a*)). The surface pattern P (FIG. 22(*b*)) again comprises two regions $R_1$ and $R_2$ but here they partially overlap one another rather than abut one another as in the previous example. The first region $R_1$ again has a periphery in the shape of the digit "5" whilst the second region $R_2$ now has a periphery in the shape of a star. In each region the ink-receptive elements (shown in black) again take the form of straight parallel lines, and as before the width and periodicity of the elements is the same in both regions, and the sets are offset in the direction of periodicity by an amount correspond to the line width. Since the two regions overlap, this has the result that some of the ink-receptive elements 26 of the first region directly abut some of the ink-receptive elements 26 of the second region, resulting in larger continuous areas of the pattern being ink-receptive. However the two regions $R_1$ and $R_2$ will not overlap entirely (else there would be no change in appearance at different viewing angles). The resulting image element array 10 is shown in FIG. 22(*c*) and comprises the portions of first image $I_1$ which correspond to ink-receptive elements 26 in each region of the array, forming multicoloured image elements 12 spaced by gaps 14.

FIG. 23 shows the appearance of a security device comprising the image element array of FIG. 22(*c*) combined with an appropriate viewing element array as described above. At a first range of viewing angles, the device will exhibit the appearance shown in FIG. 23(*a*), which is a digit "5" having its interior area filled in by a portion of the first image $I_1$. This is because in the region $R_1$, the viewing elements are directing light from the image elements 12 to the viewer whereas in the region $R_2$, the viewing elements are directing light from the gaps 14 to the viewer, such that the star-shaped second region $R_2$ is not distinguishable. At the second set of viewing angles (FIG. 23(*b*)), the appearance of the device is reversed: in the first region $R_1$, the first image $I_1$ is now hidden and the digit "5" is therefore no longer visible, whilst in the star-shaped second region $R_2$, the first image is now displayed. It will be noted that the parts of the first image $I_1$ "filling in" each of the first and second regions are common to both. These parts correspond to the overlapping portions of the two regions. As before, if a second image $I_2$ is provided then that second image $I_2$ will be displayed in the second region $R_2$ at the first set of viewing angles and in the first region $R_1$ at the second set of viewing angles (i.e. replacing the blank areas shown in FIG. 23).

FIGS. 24 and 25 show a fifth example. Here, the image element array has three regions configured to give rise to an animation effect. Further, each region is configured to correspond to an area of different colour in the first image, which as will be seen below results in the device appearing to change colour upon tilting. FIG. 24(*a*) shows the first image $I_1$ which here is a circular design having radial segments extending from the centre towards the circumference of the circle, in three colours $C_1$, $C_2$, $C_3$. The surface pattern P on the production tool 25 is shown in FIG. 24(*b*)

and is divided into three regions $R_1$, $R_2$, $R_3$. Each region comprises eight radial segments emanating from a central point and corresponding to the size and shape of the aforementioned colour segments of the first image $I_1$. Thus the first region $R_1$ coincides with the eight radial segments of the first colour $C_1$ in the first image $I_1$, the second region $R_2$ coincides with the eight radial segments of the second colour $C_2$ in the first image $I_1$ and the third region $R_3$ coincides with the eight radial segments of the third colour $C_3$ in the first image $I_1$. The three regions $R_1$, $R_2$, $R_3$ are all the same size and shape as one another but are rotated relative to one another about the central point of the pattern. In order to ensure each region lines up with one of the colours in the image $I_1$, the inks are preferably applied to the production tool in register with the surface pattern P. However, only macro-level registration is required.

Within each of the three regions, a series of ink receptive elements 26 is provided in the form of straight parallel lines. As in previous examples, the respective sets of elements in each region are laterally offset relative to the other regions in the direction of periodicity. In this example, since there are three regions, the width of the lines 26 is not equal to the spacing between them—rather, the lines 26 are spaced by a distance approximately twice their width. The lateral offset of the lines between one region and the next is again about equal to the line width. The resulting image element array 10 is shown in FIG. 24(*c*) and comprises the portions of first image $I_1$ which correspond to ink-receptive elements 26 in each region of the array, forming a multicoloured set of image elements 12 spaced by gaps 14. In this case it will be noted that each individual image element is only a single colour (assuming theoretically perfect registration which may not be the case in practice).

FIG. 25 shows the appearance of a security device comprising the image element array of FIG. 24(*c*) combined with an appropriate viewing element array as described above. At a first range of viewing angles, the device will exhibit the appearance shown in FIG. 25(*a*), namely an eight-pointed star in the first colour $C_1$. This corresponds to the portion of the first image $I_1$ falling inside the first region $R_1$ of the image element array. At this viewing angle, the viewing elements in that region direct light from the image elements 12 to the viewer whereas those in the second and third regions direct light from the gaps 14 to the viewer, such that those regions appear blank. At a second range of viewing angles, shown in FIG. 25(*b*), only the second region $R_2$ will now display the first image $I_1$ to the viewer. Since this region is laterally offset relative to the first region, the eight-pointed star appears to have rotated relative to its appearance at the first viewing angle. In addition, its colour has changed to the second colour $C_2$ since all of the image elements 12 in the second region are of that colour. At a third range of viewing angles (FIG. 25(*c*)), only the third region $R_3$ of the device displays the first image $I_1$ and again the star shaped symbol appears to have rotated still further and changed to the third colour $C_3$. Of course, any number of such regions could be provided. As before, if a second image $I_2$ is provided then that second image $I_2$ will be displayed in the second and third regions $R_{2,3}$ at the first set of viewing angles, in the first and third regions $R_{1,3}$ at the second set of viewing angles and in the first and second regions $R_{1,2}$ at the third set of viewing angles (i.e. replacing the blank areas shown in FIG. 25).

It will be appreciated that all of the above effects are achieved through design of the surface pattern P provided on the production tool 25, in some cases in combination with the design of the first image $I_1$. The same principles can be extended to produce a wide variety of animation effects including expanding/contracting effects (through the use of differently sized regions) and morphing effects (though the use of differently shaped regions).

FIG. 26(*a*) is a photograph showing a portion of an exemplary image array 10 which could be made in accordance with the above-described techniques, at a much enlarged scale. In this case the pattern is a line pattern as described in many of the examples above. The first image has been formed as a multi-coloured halftone print such that multiple colours are exhibited by each of the first image elements 12 such as indicated at $C_1$ and $C_2$. The regions 14 between the line elements 12 are transparent but if the structure is placed over a second image, portions of that second image would be visible therethrough. In this case the width w of each image element 12 is 150 microns, the spacing s between them (=width of regions 14) is 150 microns and the pattern pitch is 300 microns (this sample was produced with a relatively coarse resolution for test purposes).

FIG. 26(*b*) is a photograph showing a portion of another exemplary image array 10 which could be made in accordance with the above-described techniques, again at a much enlarged scale. Again, the pattern is a line pattern of first image elements 12 and transparent intervening regions 14. The first image is multi-coloured, here consisting of two colours, which give rise to the variation in colour seen along certain of the first image elements 12 and also between different ones of the first image elements 12. For example, image element 12' is wholly displayed in a first colour $C_1$ which here appears dark, while another image element 12" is wholly of a second colour $C_2$, which here appears relatively light. Other image elements such as 12* include portions of the first colour, as well as portions of the second colour. The arrangement of the various colours will depend on the content of the first image. In this example, the first image elements 12 have a width w of approximately 30 microns and the spacing s between them is around 50 microns, the pattern pitch being around 80 microns. In this case the proportion of the image array 10 corresponding to the first image is therefore around 38%.

In all of the above embodiments, the pattern of elements 12 and gaps 14 can be configured to take any desirable form and this will be dictated by the type of security device in which the array is to be used. In the case of a one-dimensional lenticular-type device in which the viewing elements are elongate (e.g. cylindrical lenses, as shown in FIG. 1), the image elements 12 within any one region of the array will preferably be straight, parallel lines as shown for example in FIG. 27(*a*). The image array will be registered to the focusing element array in terms of orientation but not necessarily in terms of translational position along the periodic direction (i.e. x-axis, in this case). Preferably the ratio of surface area carrying first image elements 12 to that of the regions 14 therebetween will be around 1:1 so that about 50% of the available area is dedicated to each of the two images $I_1$ and $I_2$ (or to $I_1$ and a blank "image" if no second image is provided). In this way, the first image will be displayed at approximately half of the possible viewing angles and the second image will be displayed over the other half. However this is not essential and the relative proportions of each image could be varied by adjusting the element width relative to the spacing between the elements. For instance, if three or more regions are to be utilised, the area covered by the image elements will be less (as in the FIG. 24/25 example). The periodicity of the pattern (i.e. the pitch between one element 12 and the next) must however be related to that of the viewing element array and lie in the same direction. Preferably, the pitch of the image elements 12 is substantially the same as that as the focusing elements 5, in which case the optical footprint of one viewing element is represented by dashed outline 5*a*. However in other cases the pitch of the viewing element array may be substantially equal to a multiple of that of the image array. For example, the line 5*b* represents a viewing element array with a pitch twice that of the image element pitch. Such an arrangement will cause the images displayed by the device to switch three times as the device is tilted from one extreme to the other, rather than just once as would be the case for a focusing element 5*a* of equal pitch.

Two-dimensional lenticular-type devices can also be formed, in which the optically variable effect is displayed as the device is tilted in either of two directions, preferably orthogonal directions. Examples of patterns suitable for forming image arrays for such devices are shown in FIGS. 27(*b*) to (*d*). In each case the image elements 12 are formed as grid patterns of "dots", with periodicity in more than one dimension. In the FIG. 27(*b*) example, the first image elements 12 are square and arranged on an orthogonal grid to form a "checkerboard" pattern with resulting regions 14 in which the first image is absent. The viewing elements in this case will be non-elongate (e.g. spherical or aspherical focussing elements, or circular or square apertures in a masking grid), and arranged on a corresponding orthogonal grid, registered to the image array in terms of orientation but not necessarily in terms of translational position along the x or y-axes. If the pitch of the viewing elements is the same as that of the image array in both the x and y directions, the footprint of one viewing element will be represented by the dashed line 5*a*. From an off-axis starting position, as the device is tilted left-right, the displayed image will switch as the different elements or regions are directed to the viewer, and likewise the same switch will be exhibited as the device is tilted up-down. If the pitch of the focusing elements is twice that of the image array, the image will switch multiple times as the device is tilted in any one direction. Again the proportion of image elements 12 to regions 14 is approximately 50% in this example.

In FIG. 27(*c*), the pattern is substantially the same as that of FIG. 27(*b*), but here the patterns elements 12 are circular rather than square. Any other "dot" shape could alternatively be used, e.g. polygonal. The regions 14 between the elements 12 join one another due to the increased spacing of the elements 12 with the result that here the proportion of the array corresponding to the first image is less than 50%.

In FIG. 27(*d*), the elements 12 are once again circular but are arranged on a close-packed hexagonal grid. This may be appropriate for example where the viewing element array is also arranged on a hexagonal grid. Again any other "dot" shape may be adopted and in this case hexagonal regions may be preferred. Once again the proportion of the array corresponding to the first image is less than 50%.

The patterns of FIGS. 27(*c*) and (*d*) could of course be reversed such that it is the image elements 12 which surround dot regions 14 in which the second image is displayed, such that the proportion of the array corresponding to the first image $I_1$ is more than 50%.

As mentioned at the outset, whilst in many of the above examples the image element array 10 has been combined with a focussing element array 5 to form a lenticular device, in other cases the image element array could be used in conjunction with other types of viewing elements such as a masking grid, to obtain an optically variable effect due to parallax. An example of such a security device 1 is shown in FIG. 28 in cross section. The image element array 10 comprising image elements 12 spaced by gaps 14 is formed on a transparent substrate 2 using any of the methods described above. A viewing element array herein the form of a masking grid 5' is applied to the opposite surface of the substrate 2. The masking grid comprises an opaque layer 5*a*, which may be printed or formed of metal for example, defining apertures 5*b* therethrough. The apertures 5*b* are periodically arranged in at least one dimension. For instance, the apertures may take the form of a series of parallel straight lines, or a grid of dot-shaped apertures. Due to the finite thickness t of the substrate 2, the image elements 12 are revealed to a greater or lesser extent by the apertures depending on the viewing angle. For instance, in the arrangement shown, when the device is viewed by observer $O_1$ along its normal, the opaque portions 5*a* of masking grid 5' conceal each of the image elements 12 and hence the first image 1 is not displayed. When viewed at another angle, the image elements 12 will be revealed through the apertures 5*b* and the first image $I_1$ will become apparent. It may be necessary to view such devices in transmitted light in order to obtain the effect.

The viewing element array (whether a masking grid, focussing elements array or another type) can be combined with the image element array 10 in various different ways and indeed this may be performed in a separate process from the manufacture of the image element array itself, potentially by a different entity. However, some examples of processes for combining the two components and thereby forming a security device will now be described with reference to FIGS. 29 to 32.

FIG. 29 shows a first example of manufacturing apparatus. A substrate 2 is provided which here is at least semi-transparent. On one side of the substrate, an image element array 10 is applied from a production tool 25 using any of the above-described methods. A viewing element array, here in the form of focussing elements 5, is applied to the other surface of the substrate 2. This can be done before the image element array 10 is applied to the substrate (indicated by station 30 in dashed lines), or after (indicated by station 30 in solid lines), and in both cases could be performed in-line with the image element array manufacturing process (as shown), or off-line (not shown). The focussing elements 5 can be formed by cast-curing apparatus 30, e.g. comprising a applicator 30 for applying a transparent curable material to the surface of the substrate 2, and an embossing die 32 which then contacts the curable material to shape the focussing elements into its surface. The curable material is exposed to curing energy (e.g. UV radiation) to cure it and fix the shape of the focussing elements, either during or after forming. Alternatively, the curable material can be applied direct to the embossing die and then transferred on to the substrate. In other examples, the focussing elements could be formed by thermal embossing.

FIG. 30 shows an exemplary security document 60, here a polymer banknote, with a security device 1 which may be made by the above process. The image array 10 is applied to a transparent document substrate 2 in a window region defined by a gap in opacifying layers 105*a*, 105*b* provided on the document substrate (before or after applying the image element array 10). The image array 10 is arranged so that the image elements 12 can be viewed through the document substrate 2. On the opposite side of the document substrate 2, a focusing element array 5 is provided to complete the security device. The focusing element array 5 and/or the image array 10 may be formed directly on the substrate as described above or on respective additional layer(s) which are adhered to the substrate (not shown). The device 1 may also be formed in a half-window region, for example in FIG. 30 by extending the lower opacifying layer 105*b* across the device 1.

FIG. 31 shows another example of apparatus for manufacturing a security device. In this case a second image $I_2$ is provided in addition to the image array 10. The substrate 2 may be transparent or opaque, e.g. paper. The second image $I_2$ is applied to the substrate 2 at a station 40 which could be any type of printing apparatus or could be a metal deposition apparatus, for example. The application of the second image could be carried out in-line with the following image element array manufacturing process (as shown) or off-line. Any of the methods described above can then be used to form an image element array 10 on top of the second image $I_2$ on the substrate 2. Finally, a viewing element array 5 is applied over the image element array 10. This could be formed by cast curing or thermal embossing, as before. If necessary an additional optical spacing layer can be applied between the image element array 10 and the viewing elements.

FIGS. 32(*a*) and (*b*) show an exemplary security document 100, here a paper-based banknote, provided with a security device 1 as formed by the process described with respect to FIG. 31. The banknote surface carries graphics such as star indicium 101 forming part of second image $I_2$, which have been printed on the banknote in a separate conventional process, e.g. by intaglio printing. The security device 1 is applied over a portion of the star shaped indicium 101, e.g. in the form of a foil or patch, affixed by way of a transparent adhesive.

From a first viewing angle, as shown in FIG. 32(*a*), the security device 1 directs light from the image elements 12 to the viewer with the result that a portion of the underlying star-shaped indicium 101 is concealed and instead the observer sees the first image $I_1$. For simplicity this is depicted here as a uniform region but in practice a multi-coloured image is displayed as described above. When the document is tilted, at a second viewing angle as shown in FIG. 32(*b*), the security device 1 directs light from the regions 14 between the first image elements 12 to the viewer, i.e. exhibiting second image $I_2$ which here is the underlying star graphic 101. Hence the full star shape is visible.

It will be appreciated from the above examples that different aspects of the manufacturing process which results in the complete security device 1 can be performed separately from one another, potentially on different manufacturing lines and possibly by different entities. For instance, in this example manufacture of the image element array 10 and overlapping viewing elements may be carried out by a first entity and the resulting product supplied as a security article such as a thread, strip, foil or patch, to another entity which has produced the security document 100 (including the graphics thereon), which then applies or otherwise incorporates the security article into or onto the document. It would also be possible for the lens array 5 to be formed in yet another separate process and later combined with the array of image elements 12 at the time of application to the security document 100.

Security devices of the sorts described above can be incorporated into or applied to any product for which an authenticity check is desirable. In particular, such devices may be applied to or incorporated into documents of value such as banknotes, passports, driving licences, cheques, identification cards etc. The image element array and/or the complete security device can either be formed directly on the security document or may be supplied as part of a security article, such as a security thread or patch, which can then be applied to or incorporated into such a document.

Such security articles can be arranged either wholly on the surface of the base substrate of the security document, as in the case of a stripe or patch, or can be visible only partly on the surface of the document substrate, e.g. in the form of a windowed security thread. Security threads are now present in many of the world's currencies as well as vouchers, passports, travellers' cheques and other documents. In many cases the thread is provided in a partially embedded or windowed fashion where the thread appears to weave in and out of the paper and is visible in windows in one or both surfaces of the base substrate. One method for producing paper with so-called windowed threads can be found in EP-A-0059056. EP-A-0860298 and WO-A-03095188 describe different approaches for the embedding of wider partially exposed threads into a paper substrate. Wide threads, typically having a width of 2 to 6 mm, are particularly useful as the additional exposed thread surface area allows for better use of optically variable devices, such as that presently disclosed.

The security article may be incorporated into a paper or polymer base substrate so that it is viewable from both sides of the finished security substrate at at least one window of the document. Methods of incorporating security elements in such a manner are described in EP-A-1141480 and WO-A-03054297. In the method described in EP-A-1141480, one side of the security element is wholly exposed at one surface of the substrate in which it is partially embedded, and partially exposed in windows at the other surface of the substrate.

Base substrates suitable for making security substrates for security documents may be formed from any conventional materials, including paper and polymer. Techniques are known in the art for forming substantially transparent regions in each of these types of substrate. For example, WO-A-8300659 describes a polymer banknote formed from a transparent substrate comprising an opacifying coating on both sides of the substrate. The opacifying coating is omitted in localised regions on both sides of the substrate to form a transparent region. In this case the transparent substrate can be an integral part of the security device or a separate security device can be applied to the transparent substrate of the document. WO-A-0039391 describes a method of making a transparent region in a paper substrate. Other methods for forming transparent regions in paper substrates are described in EP-A-723501, EP-A-724519, WO-A-03054297 and EP-A-1398174.

The security device may also be applied to one side of a paper substrate, optionally so that portions are located in an aperture formed in the paper substrate. An example of a method of producing such an aperture can be found in WO-A-03054297. An alternative method of incorporating a security element which is visible in apertures in one side of a paper substrate and wholly exposed on the other side of the paper substrate can be found in WO-A-2000/39391.

Examples of such documents of value and techniques for incorporating a security device will now be described with reference to FIGS. 33 to 36.

FIG. 33 depicts an exemplary document of value 100, here in the form of a banknote. FIG. 33*a* shows the banknote in plan view whilst FIG. 33*b* shows a cross-section of the same banknote along the line X-X' and FIG. 33*c* shows a cross-section through a variation of the banknote. In this case, the banknote is a polymer (or hybrid polymer/paper) banknote, having a transparent substrate 2. Two opacifying layers 105*a* and 105*b* are applied to either side of the transparent substrate 2, which may take the form of opacifying coatings such as white ink, or could be paper layers laminated to the substrate 2.

The opacifying layers 105*a* and 105*b* are omitted across selected regions 102 (and 102'), each of which forms a window within which a security device 1, 1' is located. In FIG. 33(*b*), a security device 1 is disposed within window 101, with a focusing element array 5 arranged on one surface of the transparent substrate 2, and image array 10 on the other (e.g. as in FIG. 30 above). FIG. 33(*c*) shows a variation in which a second security device 10' is also provided on banknote 100, in a second window 102'. The arrangement of the second security device 1' can be reversed so that its optically variable effect is viewable from the opposite side of the security document as that of device 1, if desired.

It will be appreciated that, if desired, any or all of the windows 102, 102' could instead be "half-windows", in which an opacifying layer (e.g. 105*a* or 105*b*) is continued over all or part of the image array 10. Depending on the opacity of the opacifying layers, the half-window region will tend to appear translucent relative to surrounding areas in which opacifying layers 105*a* and 105*b* are provided on both sides.

In FIG. 34 the banknote 100 is a conventional paper-based banknote provided with a security article 101 in the form of a security thread, which is inserted during paper-making such that it is partially embedded into the paper so that portions of the paper 105*a* and 105*b* lie on either side of the thread. This can be done using the techniques described in EP0059056 where paper is not formed in the window regions during the paper making process thus exposing the security thread 101 in window regions 102*a,b,c* of the banknote. Alternatively the window regions 102*a,b,c* may for example be formed by abrading the surface of the paper in these regions after insertion of the thread. It should be noted that it is not necessary for the window regions to be "full thickness" windows: the thread 101 need only be exposed on one surface if preferred. The security device is formed on the thread 101, which comprises a transparent substrate a focusing array 5 provided on one side and an image array 10 provided on the other. Windows 102 reveal parts of the device 1, which may be formed continuously along the thread. (In the illustration, the lens arrays are depicted as being discontinuous between each exposed region of the thread, although in practice typically this will not be the case and the lens arrays (and image arrays) will be formed continuously along the thread. Alternatively several security devices could be spaced from each other along the thread, as in the embodiment depicted, with different or identical images displayed by each).

In FIG. 35, the banknote 100 is again a conventional paper-based banknote, provided with a strip element or insert 103. The strip 103 is based on a transparent substrate and is inserted between two plies of paper 105*a* and 105*b*. The security device 1 is formed by a lens array 5 on one side of the strip substrate 103, and an image array 10 on the other. The paper plies 105*a* and 105*b* are apertured across region 102 to reveal the security device 1, which in this case may be present across the whole of the strip 103 or could be localised within the aperture region 102. It should be noted that the ply 105*b* need not be apertured and could be continuous across the security device.

A further embodiment is shown in FIG. 36 where FIGS. 36(*a*) and (*b*) show the front and rear sides of the document 100 respectively, and FIG. 36(*c*) is a cross section along line Z-Z'. Security article 103 is a strip or band comprising a security device 1 according to any of the embodiments described above. The security article 103 is formed into a security document 100 comprising a fibrous substrate, using a method described in EP-A-1141480. The strip is incorporated into the security document such that it is fully exposed on one side of the document (FIG. 36(*a*)) and exposed in one or more windows 102 on the opposite side of the document (FIG. 36(*b*)). Again, the security device 1 is formed on the strip 103, which comprises a transparent substrate with a lens array 5 formed on one surface and a co-operating image array 10 as previously described on the other Alternatively a similar construction can be achieved by providing paper 100 with an aperture 102 and adhering the strip element 103 onto one side of the paper 100 across the aperture 102. The aperture may be formed during papermaking or after papermaking for example by die-cutting or laser cutting.

In still further embodiments, a complete security device 1 could be formed entirely on one surface of a security document which could be transparent, translucent or opaque, e.g. a paper banknote irrespective of any window region. The image array 10 can be affixed to the surface of the substrate, e.g. applying it directly thereto, or by forming it on another film which is then adhered to the substrate by adhesive or hot or cold stamping, either together with a corresponding focusing element array 5 or in a separate procedure with the focusing array 5 being applied subsequently.

In general when applying a security article such as a strip or patch carrying the security device to a document, it is preferable to bond the article to the document substrate in such a manner which avoids contact between those focusing elements, e.g. lenses, which are utilised in generating the desired optical effects and the adhesive, since such contact can render the lenses inoperative. For example, the adhesive could be applied to the lens array(s) as a pattern that leaves an intended windowed zone of the lens array(s) uncoated, with the strip or patch then being applied in register (in the machine direction of the substrate) so the uncoated lens region registers with the substrate hole or window.

The security device of the current invention can be made machine readable by the introduction of detectable materials in any of the layers or by the introduction of separate machine-readable layers. Detectable materials that react to an external stimulus include but are not limited to fluorescent, phosphorescent, infrared absorbing, thermochromic, photochromic, magnetic, electrochromic, conductive and piezochromic materials.

Additional optically variable devices or materials can be included in the security device such as thin film interference elements, liquid crystal material and photonic crystal materials. Such materials may be in the form of filmic layers or as pigmented materials suitable for application by printing. If these materials are transparent they may be included in the same region of the device as the security feature of the current invention or alternatively and if they are opaque may be positioned in a separate laterally spaced region of the device.

The security device may comprise a metallic layer laterally spaced from the security feature of the current invention. The presence of a metallic layer can be used to conceal the presence of a machine readable dark magnetic layer. When a magnetic material is incorporated into the device the magnetic material can be applied in any design but common examples include the use of magnetic tramlines or the use of magnetic blocks to form a coded structure. Suitable magnetic materials include iron oxide pigments ($Fe_2O_3$ or $Fe_3O_4$), barium or strontium ferrites, iron, nickel, cobalt and alloys of these. In this context the term "alloy" includes materials such as Nickel:Cobalt, Iron:Aluminium:Nickel: Cobalt and the like. Flake Nickel materials can be used; in addition Iron flake materials are suitable. Typical nickel flakes have lateral dimensions in the range 5-50 microns and a thickness less than 2 microns. Typical iron flakes have lateral dimensions in the range 10-30 microns and a thickness less than 2 microns.

In an alternative machine-readable embodiment a transparent magnetic layer can be incorporated at any position within the device structure. Suitable transparent magnetic layers containing a distribution of particles of a magnetic material of a size and distributed in a concentration at which the magnetic layer remains transparent are described in WO03091953 and WO03091952.

Negative or positive indicia may be created in the metallic layer or any suitable opaque layer. One way to produce partially metallised/demetallised films in which no metal is present in controlled and clearly defined areas, is to selectively demetallise regions using a resist and etch technique such as is described in U.S. Pat. No. 4,652,015. Other techniques for achieving similar effects are for example aluminium can be vacuum deposited through a mask, or aluminium can be selectively removed from a composite strip of a plastic carrier and aluminium using an excimer laser. The metallic regions may be alternatively provided by printing a metal effect ink having a metallic appearance such as Metalstar® inks sold by Eckart.

The invention claimed is:

1. A method of manufacturing an image element array for an optically variable security device, comprising:

providing a production tool having a surface pattern of ink-receptive elements spaced by areas which are not ink-receptive, the ink-receptive elements defining image elements of the desired image element array;

applying a multi-coloured first image formed of a plurality of inks to only the ink-receptive elements of the surface pattern and not to the areas in between;

transferring only portions of the multi-coloured first image corresponding to the image elements of the desired image element array from the production tool to a substrate, by bringing the plurality of inks on the surface pattern into contact with the substrate or with a transfer assembly which then contacts the substrate, whereby an image element array is formed on the substrate;

wherein the surface pattern on the production tool is configured such that, when a viewing element array is overlapped with the image element array, each viewing element within a first region of the image element array directs light from a respective one of the image elements or from a respective one of gaps between the image elements in dependence on a viewing angle, whereby depending on the viewing angle the viewing element array in the first region directs light from either the array of image elements or from the gaps therebetween, such that upon changing the viewing angle, the first image is displayed by the image elements across the first region of the image element array at a first range of viewing angles and not at a second range of viewing angles, and wherein the surface pattern comprises either:

a surface relief structure of elevations and depressions, the elevations forming the ink-receptive elements and the depressions forming the areas which are not ink-receptive; or an arrangement of hydrophilic and hydrophobic parts of the surface of the production tool, the hydrophobic parts forming the ink-receptive elements and the hydrophilic parts forming the areas which are not ink-receptive.

2. A method according to claim 1, wherein each of the plurality of inks is applied to the surface pattern in accordance with a respective image component representing at least one area of the first image having a colour to which the ink contributes, at least two of the image components corresponding to different areas of the first image such that at least two of the plurality of inks are applied to different respective areas of the surface pattern.

3. A method according to claim 1, wherein at least some of the ink-receptive elements individually receive two or more of the plurality of inks in respective laterally offset areas of the element, whereby at least some of the image elements in the image element array formed on the substrate are individually multi-coloured.

4. A method according to claim 1, wherein the multi-coloured first image is applied to the surface pattern by either:

applying each of the plurality of inks to the production tool sequentially, in register with one another; or applying each of the plurality of inks to a collection surface in register with one another and then transferring the plurality of inks simultaneously from the collection surface onto the surface pattern.

5. A method according to claim 1, wherein each of the plurality of inks is applied from a respective patterned tool being a patterned lithographic printing plate, a patterned chablon plate, a patterned anilox roller, or a patterned gravure roller.

6. A method according to claim 1, wherein in the first region of the image element array, the surface pattern is configured such that the image elements have a same width as one another and are arranged periodically at least in a direction parallel to the width of each of the elements.

7. A method according to claim 1, wherein in the first region of the image element array, the surface pattern is configured either such that the image elements are elongate image elements; or such that the image elements are arranged in a periodic two-dimensional grid.

8. A method according to claim 1, wherein the surface pattern is configured such that the image elements are 100 microns or less in at least one dimension.

9. A method according to claim 1, further comprising providing a second image overlapping at least part of the image element array such that elements of the second image are exposed through the gaps between the elements of the first image, whereby the elements of both images can be viewed from a same side of the image array.

10. An image element array manufactured in accordance with claim 1.

11. A method of manufacturing a security device, comprising:

(i) manufacturing an image element array using the method of claim 1; and (ii) providing a viewing element array overlapping the image element array;

wherein the image element array and viewing element array are configured to co-operate such that each viewing element within a first region of the image element array directs light from a respective one of the image elements or from a respective one of the gaps between the image elements in dependence on the viewing angle, whereby depending on the viewing angle the viewing element array in the first region directs light from either the array of image elements or from the gaps therebetween, such that upon changing the viewing angle, the first image is displayed by the image elements across the first region of the image element array at a first range of viewing angles and not at a second range of viewing angles.

12. A method according to claim 11, wherein in the first region of the image element array, the surface pattern is configured such that the image elements have a same width as one another and are arranged periodically at least in a direction parallel to the width of each of the elements, and wherein at least in the first region, the viewing element array is periodic in at least one dimension.

13. A method according to claim 11, wherein the viewing element array is registered to the image element array at least in terms of orientation.

14. A method according to claim 11, wherein the viewing element array is a focusing element array, the focusing elements comprising lenses or mirrors.

15. A security device manufactured in accordance with claim 11.

16. A security article comprising a security device according to claim 15, wherein the security article is a security thread, strip, foil, insert, transfer element, label, or patch.

17. A security document comprising a security device according to claim 15, wherein the security document is a banknote, check, passport, identity card, driver's license, certificate of authenticity, fiscal stamp, or other document for securing value or personal identity.

18. A method of manufacturing an image element array for an optically variable security device, comprising:

providing a production tool having a surface pattern of ink-receptive elements spaced by areas which are not ink-receptive, the ink-receptive elements defining the image elements of the desired image element array;

applying a multi-coloured first image formed of a plurality of inks to only the ink-receptive elements of the surface pattern and not to the areas in between;

transferring only portions of the multi-coloured first image corresponding to the image elements of the desired image element array from the production tool to a substrate, by bringing the plurality of inks on the surface pattern into contact with the substrate or with a transfer assembly which then contacts the substrate, whereby an image element array is formed on the substrate;

wherein the surface pattern on the production tool is configured such that the image elements have a same width as one another and are arranged periodically at least in a direction parallel to the width of each of the elements, spaced by gaps therebetween, and wherein the surface pattern comprises either:

a surface relief structure of elevations and depressions, the elevations forming the ink-receptive elements and the depressions forming the areas which are not ink-receptive; or an arrangement of hydrophilic and hydrophobic parts of the surface of the production tool, the hydrophobic parts forming the ink-receptive elements and the hydrophilic parts forming the areas which are not ink-receptive.

19. A method of manufacturing a security device, comprising:

(i) manufacturing an image element array using the method of claim 18; and (ii) providing a viewing element array overlapping the image element array;

wherein the image element array and viewing element array are configured to co-operate such that each viewing element within a first region of the image element array directs light from a respective one of the image elements or from a respective one of the gaps between the image elements in dependence on the viewing angle, whereby depending on the viewing angle the viewing element array in the first region directs light from either the array of image elements or from the gaps therebetween, such that upon changing the viewing angle, the first image is displayed by the image elements across the first region of the image element array at a first range of viewing angles and not at a second range of viewing angles.

* * * * *